US010394168B2

(12) United States Patent
Seki et al.

(10) Patent No.: US 10,394,168 B2
(45) Date of Patent: Aug. 27, 2019

(54) ROTATOR CONTROL DEVICE, CONVEYANCE DEVICE, IMAGE FORMING APPARATUS, AND ROTATOR CONTROL METHOD

(71) Applicant: Ricoh Company, Ltd., Tokyo (JP)

(72) Inventors: Takafumi Seki, Kanagawa (JP); Hiromichi Matsuda, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 7 days.

(21) Appl. No.: 15/919,471

(22) Filed: Mar. 13, 2018

(65) Prior Publication Data

US 2018/0265314 A1 Sep. 20, 2018

(30) Foreign Application Priority Data

Mar. 17, 2017 (JP) ..... 2017-052263

(51) Int. Cl.
*G03G 15/16* (2006.01)
*G03G 15/00* (2006.01)

(52) U.S. Cl.
CPC ..... *G03G 15/1615* (2013.01); *G03G 15/5008* (2013.01); *B65H 2801/06* (2013.01); *G03G 15/652* (2013.01); *G03G 15/6555* (2013.01); *G03G 2221/1657* (2013.01)

(58) Field of Classification Search
CPC ..... G03G 15/5008; G03G 15/1615
See application file for complete search history.

(56) References Cited

U.S. PATENT DOCUMENTS

| | | | |
|---|---|---|---|
| 2002/0113357 | A1 | 8/2002 | Seto et al. |
| 2004/0086299 | A1 | 5/2004 | Matsuda et al. |
| 2005/0053388 | A1 | 3/2005 | Yokoyama et al. |
| 2005/0249524 | A1 | 11/2005 | Matsuda et al. |
| 2006/0088338 | A1 | 4/2006 | Matsuda et al. |
| 2006/0110189 | A1 | 5/2006 | Matsuda et al. |
| 2006/0133873 | A1 | 6/2006 | Andoh et al. |
| 2006/0153604 | A1 | 7/2006 | Matsuda et al. |
| 2006/0165442 | A1 | 7/2006 | Kobayashi et al. |
| 2006/0182471 | A1 | 8/2006 | Okamura et al. |

(Continued)

FOREIGN PATENT DOCUMENTS

| | | |
|---|---|---|
| JP | 2011-081347 | 4/2011 |
| JP | 2013-029807 | 2/2013 |

(Continued)

*Primary Examiner* — Michael C McCullough
(74) *Attorney, Agent, or Firm* — Xsensus LLP

(57) ABSTRACT

A rotator control device includes drivers to drive rotators for sheet conveyance, respectively; and a processor including a selector to select, from the rotators, a pair of a first rotator subjected to rotation speed adjustment and a second rotator adjacent to the first rotator, and an acquisition unit to acquire a torque-related value representing a driving torque value of a driver to drive the second rotator or a value proportional thereto. The processor further includes a speed adjuster to adjust a rotation speed of the first rotator to approximate a variation in the torque-related value to zero. The selector selects a subsequent pair after adjustment of the rotation speed, designates the first rotator of the preceding pair as the second rotator of the subsequent pair, and selects, as the first rotator, a rotator adjacent to the first rotator of the preceding pair, opposite the second rotator of the preceding pair.

12 Claims, 13 Drawing Sheets

(56) References Cited

U.S. PATENT DOCUMENTS

| | | | |
|---|---|---|---|
| 2006/0184258 | A1 | 8/2006 | Matsuda et al. |
| 2006/0275056 | A1 | 12/2006 | Matsuda et al. |
| 2007/0172257 | A1 | 7/2007 | Matsuda et al. |
| 2007/0217830 | A1 | 9/2007 | Matsuda et al. |
| 2007/0231022 | A1 | 10/2007 | Yokoyama et al. |
| 2008/0013972 | A1 | 1/2008 | Matsuda |
| 2008/0170884 | A1 | 7/2008 | Matsuda |
| 2008/0175612 | A1 | 7/2008 | Oikawa et al. |
| 2008/0232880 | A1 | 9/2008 | Noguchi et al. |
| 2008/0247781 | A1 | 10/2008 | Matsuda et al. |
| 2008/0303202 | A1 | 12/2008 | Noguchi et al. |
| 2009/0060613 | A1 | 3/2009 | Matsuda et al. |
| 2009/0169225 | A1 | 7/2009 | Murata et al. |
| 2009/0190972 | A1 | 7/2009 | Ohkubo et al. |
| 2009/0238588 | A1 | 9/2009 | Matsuda et al. |
| 2009/0238613 | A1 | 9/2009 | Ueda et al. |
| 2009/0263158 | A1 | 10/2009 | Murata et al. |
| 2009/0322020 | A1 | 12/2009 | Iwata et al. |
| 2009/0324262 | A1 | 12/2009 | Matsuda et al. |
| 2010/0017019 | A1 | 1/2010 | Andoh et al. |
| 2011/0013919 | A1 | 1/2011 | Matsuda |
| 2011/0064496 | A1 | 3/2011 | Ashikawa |
| 2011/0280627 | A1 | 11/2011 | Matsuda |
| 2011/0293328 | A1 | 12/2011 | Matsuda et al. |
| 2012/0326387 | A1 | 12/2012 | Ishizaki et al. |
| 2014/0056618 | A1 | 2/2014 | Matsuda et al. |
| 2014/0356027 | A1 | 12/2014 | Yamazaki et al. |
| 2015/0053032 | A1 | 2/2015 | Yamazaki et al. |
| 2015/0261140 | A1 | 9/2015 | Miyawaki et al. |
| 2016/0216649 | A1 | 7/2016 | Matsuda et al. |
| 2016/0298730 | A1 | 10/2016 | Matsuda et al. |
| 2017/0364011 | A1 | 12/2017 | Seki et al. |

FOREIGN PATENT DOCUMENTS

| | | |
|---|---|---|
| JP | 2014-184988 | 10/2014 |
| JP | 2016-139132 | 8/2016 |

ROTATOR CONTROL DEVICE, CONVEYANCE DEVICE, IMAGE FORMING APPARATUS, AND ROTATOR CONTROL METHOD

CROSS-REFERENCE TO RELATED APPLICATIONS

This patent application is based on and claims priority pursuant to 35 U.S.C. § 119(a) to Japanese Patent Application No. 2017-052263, filed on Mar. 17, 2017, in the Japan Patent Office, the entire disclosure of which is hereby incorporated by reference herein.

BACKGROUND

Technical Field

The present disclosure relates to a rotator control device, a conveyance device, an image forming apparatus, and a rotator control method.

Description of the Related Art

There are image forming apparatuses that include a mechanism to drive a secondary transfer roller and an intermediate transfer belt by a motor rotating at a constant speed.

In this mechanism, a difference between the speed of movement of surface (i.e., rotation speed) of the intermediate transfer belt and that of the secondary transfer roller generates torque interference between the intermediate transfer belt and the secondary transfer roller to keep the rotation speeds of the intermediate transfer belt and the secondary transfer roller constant. The torque interference may influence the drive of the intermediate transfer belt, causing misalignment in color superimposition (or color shift) or the like in image formation on the intermediate transfer belt.

SUMMARY

According to an embodiment of this disclosure, a rotator control device includes a rotator control device that includes a plurality of drivers to drive a plurality of rotators to convey a sheet, respectively and a processor including a selector, an acquisition unit, and a speed adjuster. The selector is configured to select, from the plurality of rotators, a pair of a first rotator subjected to rotation speed adjustment and a second rotator adjacent to the first rotator. The acquisition unit is configured to acquire a torque-related value representing one of a driving torque value of a corresponding driver of the plurality of drivers to drive the second rotator and a value proportional to the driving torque value of the corresponding driver to drive the second rotator. The speed adjuster is configured to adjust a rotation speed of the first rotator to approximate a variation in the torque-related value acquired by the acquisition unit to zero. The selector selects a subsequent pair from the plurality of rotators after adjustment of the rotation speed of the first rotator of a preceding pair, designates the first rotator of the preceding pair as the second rotator of the subsequent pair, and selects, as the first rotator of the subsequent pair, one of the plurality of rotators adjacent to the first rotator of the preceding pair, on a side opposite the second rotator of the preceding pair.

According to another embodiment, an image forming apparatus includes the conveyance device described above.

Yet another embodiment provides a rotator control method to control a plurality of rotators respectively driven by a plurality of drivers to convey a sheet. The method includes: selecting, from the plurality of rotators, a pair of a first rotator subjected to rotation speed adjustment and a second rotator adjacent to the first rotator; and acquiring a torque-related value representing one of a driving torque value of a corresponding driver of the plurality of drivers to drive the second rotator and a value proportional to the driving torque value of the corresponding driver to drive the second rotator. The further includes: adjusting a rotation speed of the first rotator to approximate a variation in the torque-related value acquired to zero; and selecting a subsequent pair from the plurality of rotators after adjustment of the rotation speed of the first rotator of a preceding pair. The method further includes: designating the first rotator of the preceding pair as the second rotator of the subsequent pair; and selecting, as the first rotator of the subsequent pair, one of the plurality of rotators adjacent to the first rotator of the preceding pair, on a side opposite the second rotator of the preceding pair.

BRIEF DESCRIPTION OF THE SEVERAL VIEWS OF THE DRAWINGS

A more complete appreciation of the disclosure and many of the attendant advantages and features thereof can be readily obtained and understood from the following detailed description with reference to the accompanying drawings, wherein.

Figure 1A:
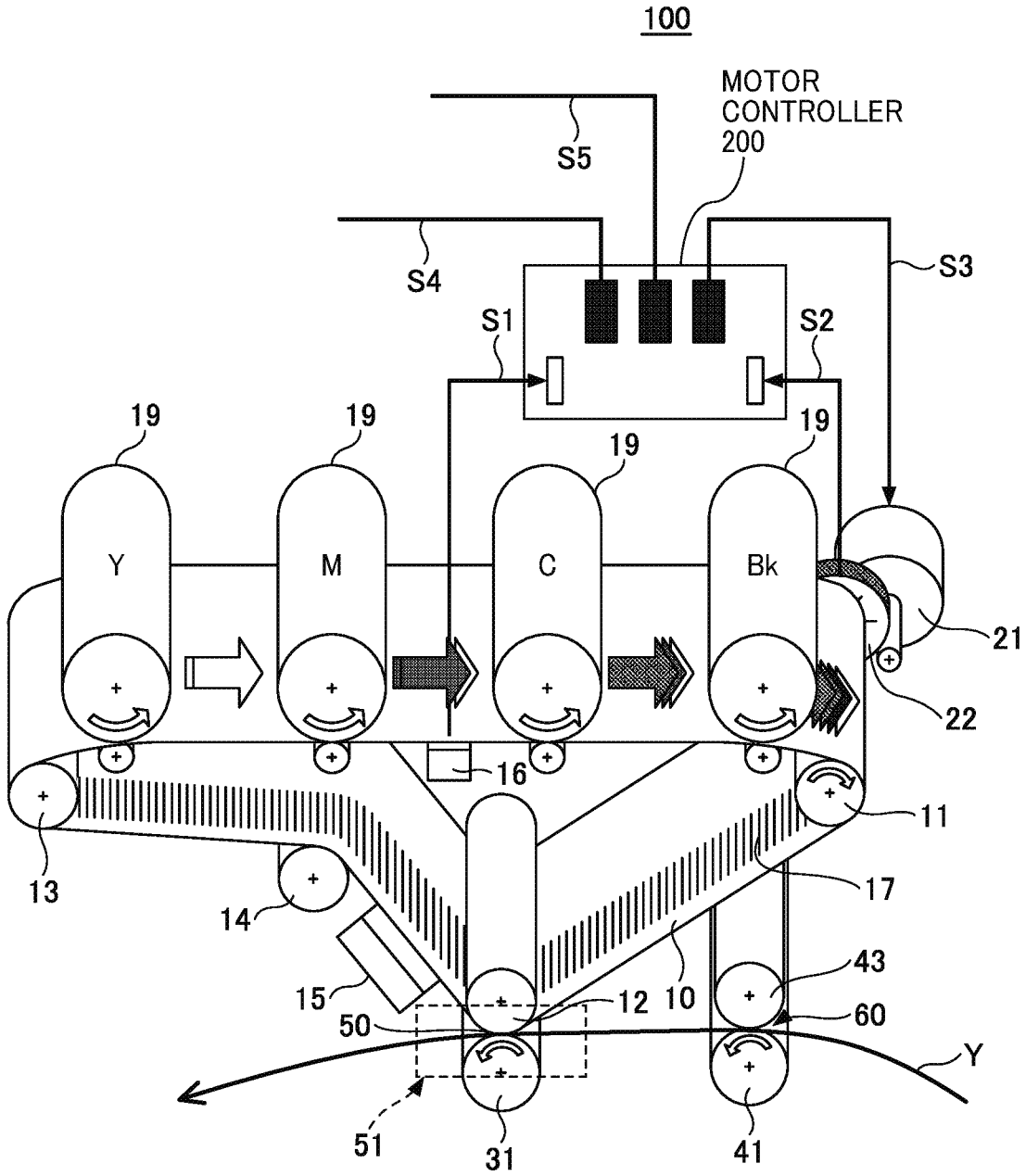
FIGS. 1A to 1C are diagrams illustrating a conveyance device according to a first embodiment.

The accompanying drawings are intended to depict embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

First Embodiment

Figure 1B:
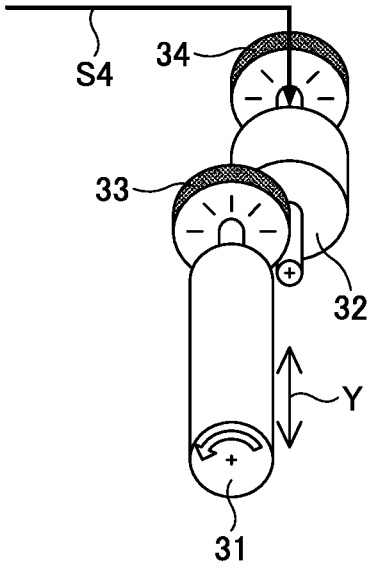
Figure 1C:
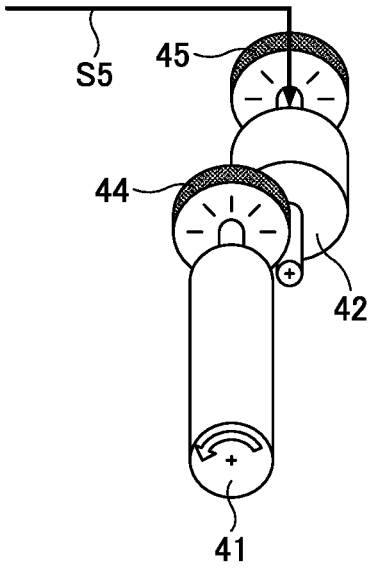

A first embodiment will be described below referring to the drawings. FIGS. 1A to 1C are diagrams illustrating a conveyance device according to a first embodiment.

For example, a conveyance device 100 illustrated in FIGS. 1A to 1C conveys a sheet-shaped medium (i.e., a conveyed object), and is incorporated in an image forming apparatus, which is described later. FIG. 1A is a diagram illustrating a schematic configuration of the conveyance device 100, FIG. 1B is a diagram illustrating a configuration around a secondary transfer portion, and FIG. 1C is a configuration around a conveying portion.

The conveyance device 100 according to the present embodiment includes an intermediate transfer belt 10, an intermediate transfer roller 11, a secondary transfer opposing roller 12, a driven roller 13, a tension roller 14, a belt cleaner 15, and a scale sensor 16. The intermediate transfer belt 10 includes an encoder pattern 17.

Furthermore, the conveyance device 100 according to the present embodiment includes an intermediate transfer motor 21, roller encoders 22, 33, and 44, motor encoders 34 and 45, a secondary transfer roller 31, a secondary transfer motor 32, a conveyance roller 41, a conveyance motor 42, and an opposing conveyance roller 43.

Still furthermore, the conveyance device 100 according to the present embodiment includes a motor controller 200 to control the intermediate transfer belt 10 so that the surface thereof moves at a constant speed.

In the conveyance device 100 according to the present embodiment, the intermediate transfer belt 10 is looped taut around a plurality of tension rollers disposed in the belt loop, and is moved endlessly by the intermediate transfer roller 11, which is one of the tension rollers. The intermediate transfer roller 11 is coupled to the intermediate transfer motor 21 serving as a drive source, via a deceleration mechanism. The deceleration mechanism has a configuration in which a small-diameter gear wheel on a rotation shaft of the intermediate transfer motor 21 meshes with a large-diameter gear wheel on a rotation shaft of the intermediate transfer roller 11.

In the present embodiment, the speed of movement of the surface (i.e., rotation speed) of the intermediate transfer belt 10 is detected with a belt encoder sensor. The front surface (outer face) or the back surface (inner face) of the intermediate transfer belt 10 includes the encoder pattern 17, and the encoder pattern 17 is read by the scale sensor 16 to detect the rotation speed of the intermediate transfer belt 10.

Note that, in the example illustrated in FIG. 1, the scale sensor 16 is disposed at the center between the driven roller 13 and the intermediate transfer roller 11, but the position of the scale sensor 16 is not limited to this description. When the scale sensor 16 is disposed at a flat portion, the rotation speed of the intermediate transfer belt 10 can be accurately measured. If the scale sensor 16 is disposed on, for example, the rotation shaft that is not flat, the curvature of the shaft affects the measurement. Due to variations in thickness of the intermediate transfer belt 10 in manufacturing or environmental changes, intervals of the encoder pattern 17 change, and accurate detection of the rotation speed is inhibited. Thus, the scale sensor 16 needs to be disposed on a flat portion.

The encoder pattern 17 may be formed by any method, such as bonding a sheet-shaped encoder pattern, directly performing pattern processing on the intermediate transfer belt 10, or integrating the encoder pattern with the intermediate transfer belt 10 in a manufacturing process.

In the present embodiment, an example of the scale sensor 16 is a reflective optical sensor including slits at equal intervals, but the scale sensor 16 is not limited to the reflective optical sensor. As long as the sensor accurately detects a surface position of the intermediate transfer belt 10 based on the encoder pattern 17, the sensor can be, for example, a charge coupled device (CCD) camera to detect the surface position by image processing. In addition, a Doppler sensor or a sensor detecting the surface position based on imaging of the surface unevenness of the belt is advantageous in obviating the encoder pattern 17.

Alternatively, the rotation speed of the intermediate transfer belt 10 can be detected using a rotary encoder sensor. The rotary encoder sensor is disposed rotation shaft of the driven roller 13. The driven roller 13 is driven in accordance with the endless movement of the intermediate transfer belt 10 to detect the rotation speed of the intermediate transfer belt 10.

In the conveyance device 100, of the entire circumferential (direction of loop) of the intermediate transfer belt 10, in a portion extending from the driven roller 13 to the intermediate transfer roller 11, photoconductor drums 19 for magenta (M), cyan (C), yellow (Y), and black (K) abut against the intermediate transfer belt 10 to form primary transfer nips for M, C, Y, and K colors. In the portions of the intermediate transfer belt 10 forming the primary transfer nips for M, C, Y, and K, transfer rollers abut against the back side of the intermediate transfer belt 10. In the conveyance device 100, a power supply applies a transfer bias to each of the transfer rollers to generate a transfer electric field between the intermediate transfer belt 10 and a corresponding photoconductor drum 19 in a primary transfer nip for each color.

In conveyance device 100, a color image is formed at a primary transfer portion. Thus, it is preferable that the rotation speed of the intermediate transfer belt 10 be detected and controlled at this portion. Therefore, disposing the rotary encoder on the driven roller 13 or disposing the scale sensor 16 between the driven roller 13 and the intermediate transfer roller 11 is preferable.

The tension roller 14 according to the present embodiment is pressed against the belt from outside the belt loop to generate constant belt tension. The belt tension generated by the tension roller 14 causes the intermediate transfer belt 10 to abut on the surfaces of the respective tension rollers, and the intermediate transfer belt 10 is conveyed in the circumferential direction. In particular, the force of contact between the surface of the driven roller 13 and the intermediate transfer belt 10 is correlated with the force of friction of the driven roller 13 for conveying the intermediate transfer belt 10, and pressing force of the tension roller 14 is set to ensure the frictional force for conveyance of the intermediate transfer belt 10.

Furthermore, in the conveyance device 100, the secondary transfer roller 31 is disposed in contact with a surface of the intermediate transfer belt 10 at a position opposing the secondary transfer opposing roller 12, and electrical charge is applied to the secondary transfer roller 31 and the surface of the intermediate transfer belt 10 to attract a recording sheet (e.g., a paper sheet) on the surface.

Still furthermore, in the conveyance device 100, the belt cleaner 15 is disposed outside the belt loop downstream from the secondary transfer roller 31 in a belt conveyance direction, and the belt cleaner 15 abuts on the intermediate transfer belt 10. The belt cleaner 15 collects foreign matter, such as toner, on the surface of the intermediate transfer belt 10 from the surface of the intermediate transfer belt 10 by a potential difference between the toner and the belt cleaner 15.

Note that, in the conveyance device 100, the conveyed object is conveyed in a conveyance direction indicated by arrow Y. Accordingly, the conveyed obj ect is conveyed from upstream from the conveyance roller 41 to the secondary transfer roller 31 and downstream therefrom in the conveyance direction. That is, in the present embodiment, a conveyance path for the conveyed object includes rotators including the intermediate transfer belt 10, the secondary transfer roller 31, and the conveyance roller 41.

To keep the rotation speed of the intermediate transfer belt 10 constant, the motor controller 200 according to the present embodiment performs feedback control on the intermediate transfer motor 21.

Specifically, the motor controller 200 outputs a drive control signal S3 to the intermediate transfer motor 21, based on an output signal S1 from the scale sensor 16 representing the rotation speed of the intermediate transfer belt 10, and an output signal S2 from the roller encoder 22 representing a rotation speed of the intermediate transfer roller 11.

Furthermore, to suppress a variation in the rotation speed of the intermediate transfer belt 10 influenced by the conveyed object passing the secondary transfer portion 50, the motor controller 200 performs feedback control on the secondary transfer motor 32 and the conveyance motor 42. Specifically, the motor controller 200 outputs a drive control signal S4 for the secondary transfer motor 32, based on the output signal S1 from the scale sensor 16 and the output signal S2 from the roller encoder 22. Similarly, the motor controller 200 outputs a drive control signal S5 for the conveyance motor 42.

Next, a mechanism around the secondary transfer roller 31 will be described (see FIG. 1B). In the conveyance device 100, the secondary transfer motor 32 is disposed separately from the intermediate transfer motor 21. The secondary transfer motor 32 is rotated according to the drive control signal S4 transmitted from the motor controller 200.

The secondary transfer motor 32 employs a brushed direct-current (DC) motor or a brushless DC motor, which is also employed for the intermediate transfer motor 21. The rotation speed of the secondary transfer motor 32 is reduced by a deceleration mechanism (a motor gear and a deceleration gear on the side of the secondary transfer roller 31). Furthermore, the secondary transfer roller 31 is rotated to further convey the conveyed object conveyed to the secondary transfer portion 50.

Opposite the secondary transfer roller 31, the secondary transfer opposing roller 12 supporting the intermediate transfer belt 10 is disposed, and the secondary transfer roller 31 contacts or separates from the secondary transfer opposing roller 12 via the intermediate transfer belt 10.

The two rollers contact (indirectly) each other by a spring. Furthermore, the secondary transfer roller 31 includes a cam mechanism movable in a direction indicated by arrow Y in FIG. 1B to separate the secondary transfer roller 31 from the secondary transfer opposing roller 12. The cam mechanism switches the contact and separation of the two rollers in the secondary transfer portion 50.

In the conveyance device 100 according to the present embodiment, to improve the transferability of the secondary transfer portion 50, the secondary transfer roller 31 is provided with an elastic layer as the surface layer. As an example, the secondary transfer roller 31 includes a thin metal pipe having a low inertia, a roller body made of rubber having a low hardness, such as silicone rubber, (elastic rubber layer) around the thin metal pipe, and a urethane coating layer coating the roller body.

Note that, the secondary transfer roller 31 can be a conductive rubber roller including a lower layer made of rubber (e.g., vulcanized rubber or silicone-based rubber) having a hardness of not greater than 40° (A scale) and a thin urethane coating layer (i.e., a surface layer) to suppress the viscosity of the rubber. Thus, in the present embodiment, the conductive rubber roller can abut and deform to increase the area of nip (pressing) and ensure the pressure necessary for transfer.

In general, when a structure other than a foam rubber structure is used to achieve a low hardness of not greater than 40° , vulcanized rubber has an increased viscosity due to addition of plasticizer. Similarly, silicone rubber also has a higher viscosity. Thus, adhesion in a portion where the intermediate transfer belt 10 pressed against the secondary transfer roller 31 (i.e., a pressed-contact portion 51) or adhesion in a portion that contacts the conveyed object hinders movement of the secondary transfer roller 31 and that of the intermediate transfer belt 10. To avoid this, the urethane coating described above is effectively applied to the surface layer.

The intermediate transfer motor 21 is controlled by the motor controller 200 to make the rotation speed of the intermediate transfer belt 10 constant.

Next, a configuration around the conveyance roller 41 will be described (see FIG. 1C).

The conveyance roller 41 defines the conveyance path. The conveyance roller 41 is one of the rotators to convey the conveyed object and is rotated by the conveyance motor 42. When the conveyance motor 42 is driven, the rotation of the conveyance motor 42 is transmitted to the conveyance roller 41 via a gear, and the conveyance roller 41 is rotated. The conveyed object is conveyed to the pressed-contact portion 51 formed by the secondary transfer roller 31 and the secondary transfer opposing roller 12, by the conveying portion 60 formed by the conveyance roller 41 and the opposing conveyance roller 43 disposed opposite the conveyance roller 41. The conveyed object which is conveyed to the pressed-contact portion 51 is further conveyed while being held between the secondary transfer roller 31 and the intermediate transfer belt 10. In other words, the pressed-contact portion 51 serves as a holding portion to hold the conveyed object between the secondary transfer roller 31 and the intermediate transfer belt 10.

As described above, in the conveyance device 100 according to the present embodiment, the conveyed object is conveyed from the conveying portion 60 to the secondary transfer portion 50. Then, the conveyance device 100 presses the secondary transfer roller 31 against the intermediate transfer belt 10 in the secondary transfer portion 50, and transfers a toner image to the conveyed object.

At this time, the rotation speeds of the rotators defining the conveyance path for the conveyed object fluctuate due to the type of conveyed object, the tolerance of each roller, changes in contact pressure, variations in roller shape with time, environment, or the like.

Furthermore, such fluctuations change the rotation speed of the intermediate transfer belt 10. In other words, a change in the rotation speed of each of the rotators defining the conveyance path for the conveyed object generates interference torque which causes the change of the driving torque of the intermediate transfer motor 21 driving the intermediate transfer belt 10.

Therefore, in the present embodiment, to keep the rotation speed constant of the intermediate transfer belt 10, the rotation speed of each rotator defining the conveyance path for the conveyed object is controlled. In other words, in the present embodiment, to generate no interference torque against the driving torque of the intermediate transfer motor 21, the rotation speed of the rotator defining the conveyance path for the conveyed object is controlled.

Note that, in the present embodiment, the rotator defining the conveyance path for the conveyed object includes for example, a roller positioned upstream from the conveyance roller 41 to convey the conveyed object to the conveyance roller 41. Furthermore, the rotator defining the conveyance path for the conveyed object includes a roller positioned downstream from the pressed-contact portion 51 in the conveyance path to convey the conveyed object to a fixing device.

Note that, the conveyed object can be, for example, a paper sheet or a sheet-shaped film, and the conveyed object according to the present embodiment may employ any medium as long as the medium can receive the transfer of an image and can be conveyed by the conveyance device 100.

Interference torque caused by a difference in rotation speed between two adjacent rotators in a conveyance path of the conveyance device 100 according to the present embodiment will be described below.

Figure 2A:
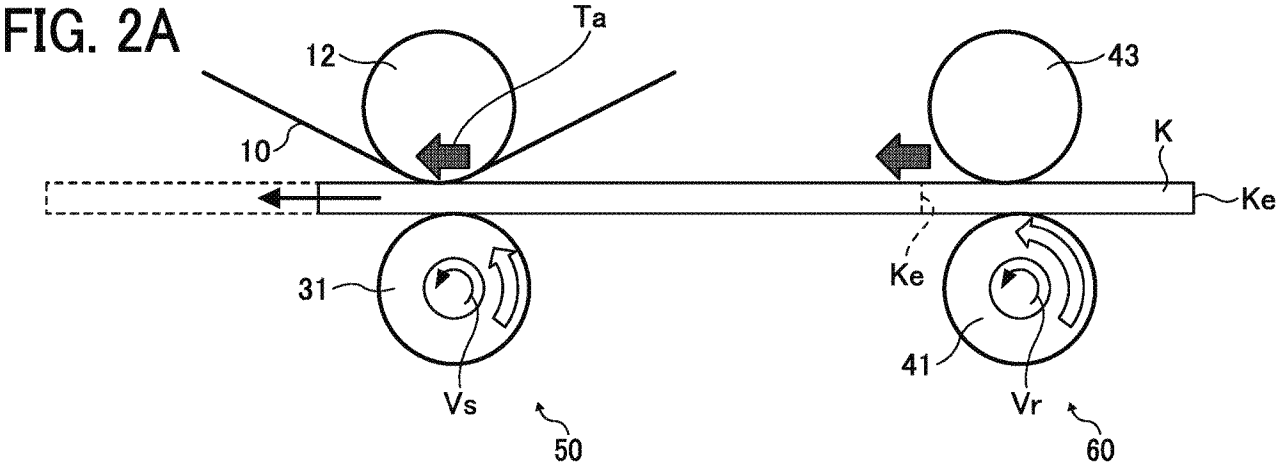
FIGS. 2A and 2B are diagrams illustrating interference torque caused by a difference in rotation speed between two rotators.
Figure 2B:
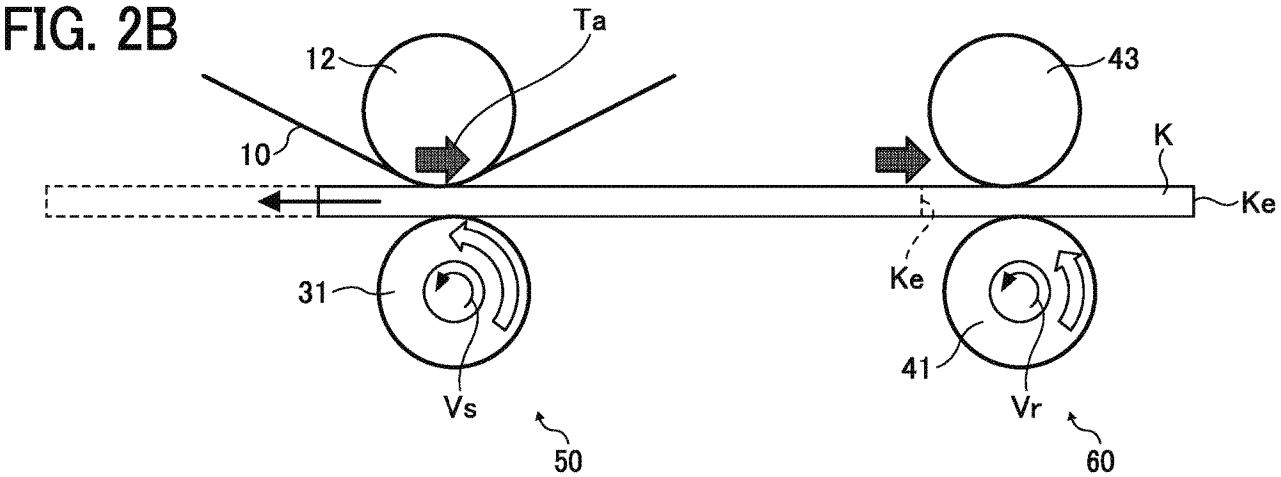

FIGS. 2A and 2B are diagrams illustrating the interference torque caused by a difference in rotation speed between two rotators.

In examples illustrated in FIGS. 2A and 2B, as the two adjacent rotators in the conveyance path, the conveyance roller 41 and the secondary transfer roller 31 are illustrated. In the examples illustrated in FIGS. 2A and 2B, the conveyance roller 41 is an upstream rotator in the conveyance direction, and the secondary transfer roller 31 is a downstream roller in the conveyance direction.

FIG. 2A is a diagram in which the rotation speed of the upstream roller is faster than the rotation speed of the downstream roller. FIG. 2B is a diagram in which the rotation speed of the upstream roller is slower than the rotation speed of the downstream roller.

In the present embodiment, since the conveyance motor 42 is subjected to feedback control based on a rotation speed obtained from the motor encoder 45, the rotation shaft of the conveyance roller 41 (the upstream roller) rotates at a constant rotation speed Vr.

Similarly, regarding the downstream roller, since the secondary transfer motor 32 is subjected to feedback control based on a rotation speed obtained from the motor encoder 34, the rotation shaft of the secondary transfer roller 31 rotates at a constant rotation speed Vs.

In the conveyance device 100, when the rotation speed of the upstream roller is different from the rotation speed of the downstream roller, the interference torque is generated between motors driving these rollers. Here, the interference torque represents torque occurring when a downstream motor driving the downstream roller is pressed or pulled by the upstream roller via the conveyed object during conveyance of the conveyed object.

In other words, in the examples illustrated in FIGS. 2A and 2B, when the rotation speed of the conveyance roller 41 (a rotation speed of the conveyance motor 42) is different from the rotation speed of the intermediate transfer belt 10, the interference torque is generated between the conveyance motor 42 and the intermediate transfer motor 21.

The interference torque is generated when the intermediate transfer motor 21 is affected by the conveyance roller 41 being pressed or pulled, via a paper sheet K (the conveyed object). The interference torque can be measured from the amount of change in driving torque Ta of the intermediate transfer motor 21 between when the paper sheet K extends from the secondary transfer roller 31 to the conveyance roller 41, and when the paper sheet K is conveyed only by the secondary transfer roller 31 without being conveyed by the conveyance roller 41.

In the present embodiment, the amount of change is made close to zero to suppress generation of the interference torque applied to the intermediate transfer motor 21, which is caused by the pressing or pulling of the paper sheet K on the conveyance roller 41.

FIG. 2A illustrates the paper sheet K extending from the conveyance roller 41 to the secondary transfer roller 31.

In FIG. 2A, since the rotation speed of the conveyance roller 41 is faster than the rotation speed of the intermediate transfer belt 10, the conveyance roller 41 presses the paper sheet K toward the secondary transfer roller 31.

In this state, the rotation speed of the secondary transfer roller 31 increases, and the interference torque is generated between the paper sheet K and the surface of the intermediate transfer belt 10. Here, since the motor controller 200 controls the intermediate transfer belt 10 to keep the rotation speed constant, the driving torque Ta of the intermediate transfer motor 21 (the secondary transfer motor 32) decreases.

In addition, in the state illustrated in FIG. 2A, when the paper sheet K is conveyed and a rear end Ke of the paper sheet K having passed through the conveying portion 60 is in only the secondary transfer portion 50, a force pressing the paper sheet K from the conveyance roller 41 to the secondary transfer roller 31 is removed. Then, the rotation speed of the secondary transfer roller 31 decreases.

In this situation, since the motor controller 200 controls the intermediate transfer belt 10 to keep the rotation speed constant, the driving torque Ta of the intermediate transfer motor 21 increases.

In the present embodiment, the conveyance path for the conveyed object has a zone in which the conveyed object is conveyed while extending from the upstream rotator to a downstream rotator. The zone is called a first conveyance zone. In addition, in the present embodiment, a zone in which the conveyed object is conveyed only by one of the upstream rotator and the downstream rotator is called a second conveyance zone.

Therefore, in the examples illustrated in FIGS. 2A and 2B, in the conveyance path, a zone in which the paper sheet K is conveyed while being in contact with both of the conveying portion 60 and the secondary transfer portion 50 is defined as the first conveyance zone, and a zone in which the paper sheet K is conveyed while being in contact with only the secondary transfer portion 50 is defined as the second conveyance zone.

Here, it is found that, as illustrated in FIG. 2A, in a state in which the upstream roller presses the conveyed object toward the downstream roller, the driving torque Ta of the downstream motor decreases in the first conveyance zone and increases in the second conveyance zone. In other words, when the rotation speed of the upstream roller is faster than the rotation speed of the downstream roller, the driving torque Ta of the downstream motor decreases in the first conveyance zone and increases in the second conveyance zone.

In FIG. 2B, since the rotation speed of the conveyance roller 41 as the upstream roller is slower than the rotation speed of the secondary transfer roller 31 as the downstream roller, the conveyance roller 41 pulls the paper sheet K from the secondary transfer roller 31.

Then, the rotation speed of the secondary transfer roller 31 decreases, and the interference torque is generated between the paper sheet K and the surface of the secondary transfer roller 31. At this time, since the motor controller 200 also controls the secondary transfer roller 31 to keep the rotation speed constant, the driving torque Ta of the intermediate transfer motor 21 increases.

Furthermore, in the state illustrated in FIG. 2B, when the paper sheet K is conveyed and the rear end Ke of the paper sheet K having passed through a pressing portion of the conveyance roller 41 is in only pressing portion of the secondary transfer roller 31, a force pulling the paper sheet K from the secondary transfer roller 31 by the conveyance roller 41 is removed. Then, the rotation speed of the secondary transfer roller 31 increases.

Therefore, since the motor controller 200 controls the intermediate transfer belt 10 to keep the rotation speed constant, the driving torque Ta of the intermediate transfer motor 21 decreases.

That is, it is known that, in the state as illustrated in FIG. 2B in which the upstream roller pulls the paper sheet K from the downstream roller, the driving torque Ta of the downstream motor increases in the first conveyance zone and decreases in the second conveyance zone. In other words, when the rotation speed of the upstream roller is slower than the rotation speed of the downstream roller, the driving torque Ta of the downstream motor increases in the first conveyance zone and decreases in the second conveyance zone. Hereinafter, a relation between a variation in torque in the first conveyance zone and a variation in torque in the second conveyance zone will be described, referring to FIG. 3.

Figure 3:
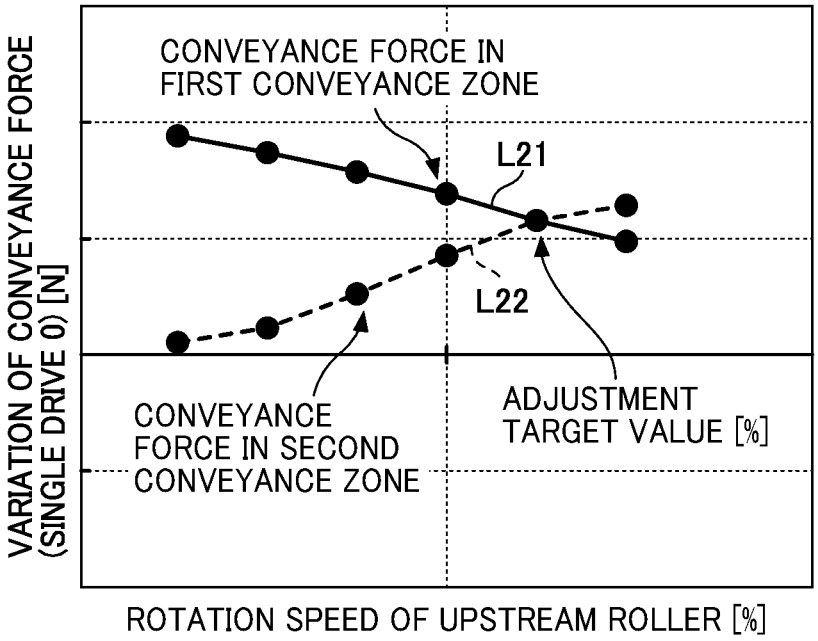
FIG. 3 is a graph illustrating interference torque generated between a downstream motor and an upstream motor.

FIG. 3 is a graph illustrating interference torque generated between the downstream motor and an upstream motor.

In FIG. 3, a ratio of fluctuations in speed of the upstream roller relative to a set speed is expressed as a percentage [%]. The set speed represents a speed on the assumption that the rotation speed of the upstream roller is equal to the rotation speed of the downstream roller. The vertical axis denotes conveyance force converted from torque.

In FIG. 3, a line L21 represents a relation between the rotation speed of the upstream roller and the conveyance force of the downstream motor (intermediate transfer conveyance force) in the first conveyance zone, and a line L22 represents a relation between the rotation speed of the upstream roller and the conveyance force of the downstream motor (intermediate transfer conveyance force) in the second conveyance zone.

As illustrated in FIG. 2, when the rotation speed of the upstream roller is faster than the rotation speed of the downstream roller, the driving torque of the downstream motor decreases in the first conveyance zone and increases in the second conveyance zone. Furthermore, when the rotation speed of the upstream roller is slower than the rotation speed of the downstream roller, the driving torque of the downstream motor increases in the first conveyance zone and decreases in the second conveyance zone.

Therefore, as illustrated in FIG. 3, the conveyance force L21 of the downstream motor in the first conveyance zone decreases with increasing rotation speed of the upstream roller, the conveyance force L22 of the downstream motor in the second conveyance zone increases with increasing rotation speed of the upstream roller.

In the present embodiment, a state in which a difference between the conveyance force L21 in the first conveyance zone and the conveyance force L22 in the second conveyance zone is zero a state where the conveyed object pressed or pulled on an extreme upstream roller does not affect the motor driving the downstream roller.

Therefore, in the present embodiment, the rotation speed of the upstream motor when a difference between the conveyance force L21 in the first conveyance zone and the conveyance force L22 in the second conveyance zone is zero is an optimum value set as a target value of the rotation speed of the upstream motor. In other words, in the present embodiment, the rotation speed of the upstream motor when a difference between the conveyance force L21 in the first conveyance zone and the conveyance force L22 in the second conveyance zone is zero is an optimum value set as a target value of the rotation speed of the upstream motor.

In the image forming apparatus, the conveyance device, and the rotator control device according to the present embodiment described below, a rotation speed is adjusted to reduce the interference torque in the conveyance path in consideration of the contents described above.

Specifically, in the present embodiment, of the rollers pressing against the conveyed object, a roller positioned extreme upstream and a roller adjacent to (downstream from) the extreme upstream roller are paired. In the present embodiment, the rotation speed of the upstream roller is controlled to reduce torque detected in the downstream roller to zero. Thus, the interference torque of this pair is made close to zero.

In the present embodiment, until an upstream roller becomes a roller at the end of the conveyance path, pairs of upstream rollers and downstream rollers are shifted upstream one by one to control the rotation speed of an upstream roller for each pair, in the conveyance path.

In the present embodiment, owing to this sequential control, interference torque can be accurately detected for an upstream roller of a pair without the influence of another roller pressing against the conveyed object, upstream from the upstream roller. Thus, in the present embodiment, the interference torque can be accurately controlled to approximate zero.

Furthermore, in the present embodiment, of rollers pressing against the conveyed object, an extreme downstream roller and a roller adjacent to (upstream from) the extreme downstream roller can also be paired. In the present embodiment, the rotation speed of the downstream roller is controlled to reduce torque detected in the upstream roller to zero. Thus the interference torque of this pair is made close to zero.

In the present embodiment, until a downstream roller becomes a roller at the end of the conveyance path, pairs of downstream rollers and upstream rollers are shifted downstream one by one to control the rotation speed of a downstream roller for each pair, in the conveyance path.

In the present embodiment, owing to this sequential control, interference torque can be accurately detected for a downstream roller of a pair without the influence of another roller pressing against the conveyed object, downstream from the downstream roller. Thus, in the present embodiment, the interference torque can be accurately controlled to approximate zero.

In the following description, a roller in which the rotation speed is adjusted is called a speed adjustment roller (first rotator), and the roller subjected to torque detection, adjacent to (upstream or downstream from) the speed adjustment roller is called a torque detection roller (second rotator).

In the present embodiment, a pair including the speed adjustment roller and the torque detection roller is shifted upstream or downstream to control the interference torque to approximate zero for each pair. Therefore, each roller in the conveyance path can have a reduced torque interference.

Note that, in the present embodiment, until the speed adjustment roller becomes a roller at an end of the conveyance path, the above control is performed, but the roller at an end is not limited to the above description. The roller at an end may not be positioned at an end of an actual conveyance path. Specifically, for example, the roller at an end may be a roller positioned at an end, of rotators in which the interference torque is generated between the respective rotators and the intermediate transfer belt 10. That is, the roller at an end can be determined in accordance with a rotator generating torque interfering with a reference torque detection roller, to be eliminated or minimized, and the accuracy of the detection.

Furthermore, the conveyance device 100 according to the present embodiment is configured so that the interference torque against the driving torque of the intermediate transfer motor 21 is reduced in the conveyance path. In other words, the conveyance device 100 according to the present embodiment is configured so that when the conveyed object is conveyed while being held in the secondary transfer portion 50 or when the intermediate transfer belt 10 is singularly rotated, the intermediate transfer motor 21 has a constant driving torque.

Accordingly, in the present embodiment, when a pair of rotators is selected, the first pair (initial pair) is defined to include the intermediate transfer belt 10 and the conveyance roller 41, and the interference torque against the driving torque Ta of the intermediate transfer motor 21 is made close to zero first. Then, in the present embodiment, a pair of rotators may be selected while shifting the pairs of the rotators one by one, after the interference torque against the driving torque Ta is eliminated.

At this time, in the present embodiment, the pairs of the rotators may be shifted in a direction largely affecting the interference torque against the driving torque Ta, on the upstream side or the downstream side from the secondary transfer portion 50, in the conveyance direction.

For example, in a general image forming apparatus, the distance from the secondary transfer portion 50 to the fuser is often greater than the distance from the secondary transfer portion 50 to the conveyance roller 41, relative to the secondary transfer portion 50. This is a result of consideration of, for example, the influence of heat in fixing or positioning of the conveyance roller 41 closer to the secondary transfer portion 50 for accuracy in conveyance timing.

In such a configuration, the rotation speed of a rotator needs to be preferentially adjusted. The rotator is positioned on the upstream side of the conveyance direction, and in the conveyance direction, the conveyance roller 41 largely affecting the interference torque is positioned.

Therefore, in such a configuration, a pair of rotators is selected while sequentially shifting the pairs of the rotators upstream from the first pair of the rotators.

In selection of a pair of rotators, the shifting direction from the first pair may be determined in accordance with nip pressure, the conveyance path, a difference in nip time, or the like. For example, when a configuration on the downstream side of the conveyance path largely affects the interference torque, a pair of rotators is selected while sequentially shifting the pairs of the rotators downstream from the first pair.

In the present embodiment, adjusting the rotation speeds of the respective rotators in this order enables the intermediate transfer motor 21 to adjust the rotation speed of another rotator, with no increase or decrease of the driving torque Ta due to another load. According to the present embodiment, the interference torque in the conveyance path can be reduced.

Figure 4:
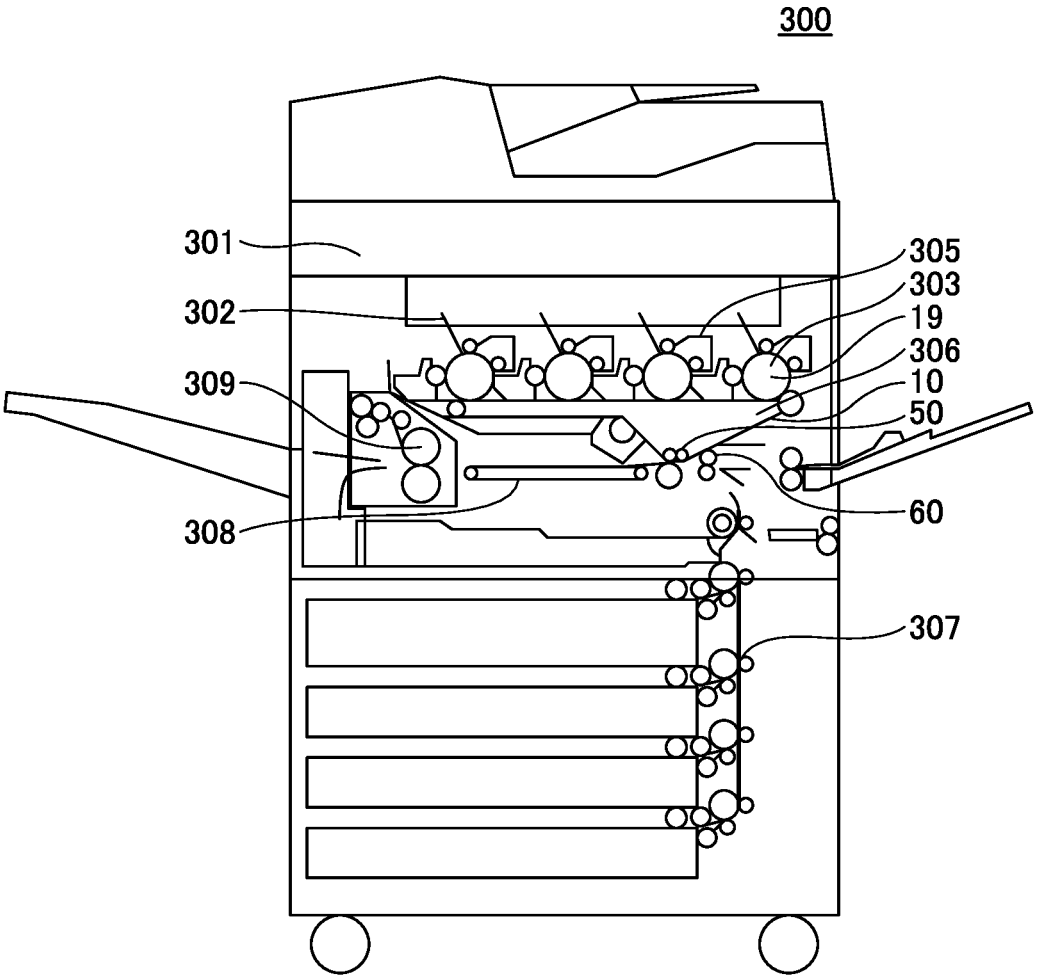
FIG. 4 is a schematic diagram illustrating a configuration of an image forming apparatus according to the first embodiment.

Hereinafter, devices according to the present embodiment will be described. FIG. 4 is a schematic diagram illustrating a configuration of the image forming apparatus according to the first embodiment.

Preferably, the image forming apparatus 300 according to the present embodiment is an electrophotographic image forming apparatus, includes a digital multifunction peripheral, and has a copy function, a printer function, a facsimile function, and the like. However, the image forming apparatus 300 can be an inkjet image forming apparatus to form an image by ejecting ink droplets, a dye sublimation thermal transfer image forming apparatus, or a dot-impact image forming apparatus. The image forming apparatus 300 according to the present embodiment includes the conveyance device 100.

The image forming apparatus 300 according to the present embodiment includes an image reader 301, an image writing unit 302, a photoconductor unit 303, the photoconductor drum 19, a developing unit 305, an intermediate transfer portion 306, the intermediate transfer belt 10, the secondary transfer portion 50, the conveying portion 60, a tray 307, a conveyor 308, and a fixing device 309.

The image forming apparatus 300 is configured so that the image reader 301 scans a document while irradiating the document by a light source, and light reflected from the document is received by a 3-line CCD sensor to read an image. The read image is subjected to image processing, such as, scanner y correction, color conversion, image separation, tone correction by an image processing unit, and then transmitted to the image writing unit 302.

In the image writing unit 302, the drive of a laser diode (LD) is modulated in accordance with image data. In the photoconductor unit 303, an electrostatic latent image is written on the photoconductor drum 19 uniformly charged and rotated, with a laser beam from the LD, applying toner by the developing unit 305 for visualization.

The image on the photoconductor drum 19 is transferred on the intermediate transfer belt 10 of an intermediate transfer unit in the intermediate transfer portion 306. When full-color copying is performed in the image forming apparatus 300, toner images of four colors (black, cyan, magenta, yellow) are sequentially overlaid on the intermediate transfer belt 10. When formation and transfer of all color images are finished, the conveying portion 60 supplies a recording medium (i.e., conveyed object) from the tray 307, timed to the intermediate transfer belt 10, and the toner image is secondarily transferred from the intermediate transfer belt 10 to the recording medium, in the secondary transfer portion 50. The recording medium to which the toner image is transferred is sent to the fixing device 309 through the conveyor 308, and discharged after the toner image is fixed to the recording medium by a fixing roller and a pressure roller.

Figure 5:
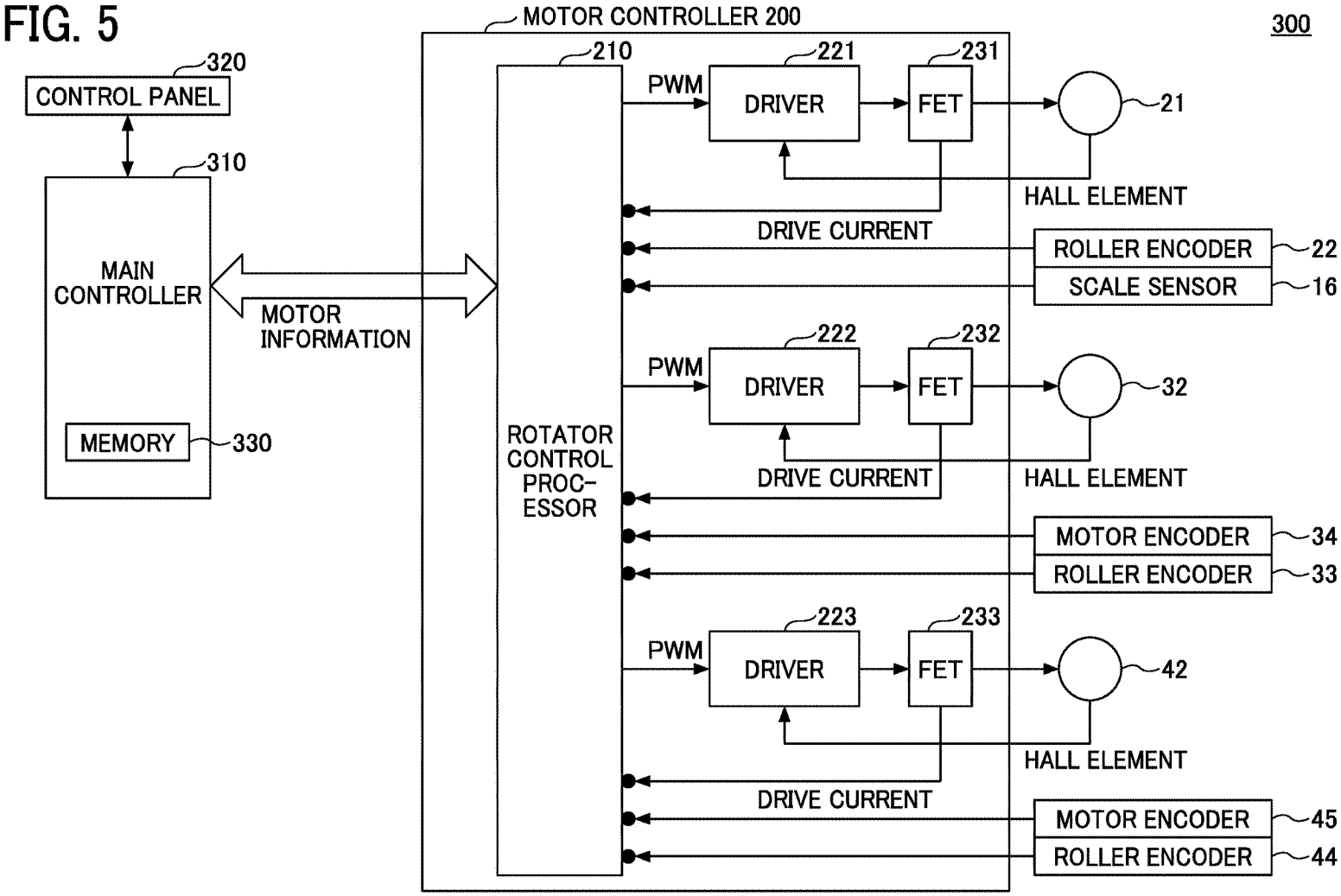
FIG. 5 is a diagram illustrating a motor controller according to the first embodiment.

FIG. 5 is a diagram illustrating the motor controller according to the first embodiment.

The motor controller 200 according to the present embodiment is included in the conveyance device 100, and controls the drive of the plurality of rotators illustrated in FIG. 1 (the intermediate transfer roller 11, the secondary transfer roller 31, the conveyance roller 41). Furthermore, the motor controller 200 according to the present embodiment controls the drive of the rotators defining the conveyance path.

In the image forming apparatus 300 according to the present embodiment, the motor controller 200 is coupled to a main controller 310 controlling the whole image forming apparatus 300 to control the drive of the rotators defining the conveyance path.

When an operation member 320 of the image forming apparatus 300 is operated to give, for example, an instruction for outputting image data, the main controller 310 gives an instruction for driving the respective motors to the motor controller 200. Specifically, when receiving, for example, the instruction for outputting image data, the main controller 310 gives instructions to the motor controller 200, for a command value to each motor, start/stop instruction, a target value of rotation speed, a rotation direction, or the like. The motor controller 200 receives this instruction and controls the drive of each motor. The main controller 310 transmits and receives information about the motor controller 200 and each motor. Furthermore, the main controller 310 includes a memory 330 storing information about a motor (motor information). The information about a motor includes, for example, the rotation speed (set speed) of each motor, a PWM value according to a command value, drive current, an encoder value, and the like.

In the motor controller 200 according to the present embodiment, a rotator control processor 210 includes a driver corresponding to a motor rotating each of the plurality of rollers defining the conveyance path, and a field effect transistor (FET). In the example illustrated in FIG. 5, as examples of motors for rotating the respective rollers defining the conveyance path, the intermediate transfer motor 21, the secondary transfer motor 32, and the conveyance motor 42 are illustrated.

The drivers 221, 222, and 223, the FETs 231, 232, and 233 of the rotator control processor 210 correspond to the intermediate transfer motor 21, the secondary transfer motor 32, and the conveyance motor 42, respectively.

Although detailed description will be made later, the rotator control processor 210 adjusts a target value of the rotation speed of the secondary transfer motor 32 and a target value of the rotation speed of the conveyance motor 42 first, and stores the adjustment target values in the memory 330. Note that the rotation speed of the secondary transfer motor 32 is the same as the rotation speed of the secondary transfer roller 31, and the rotation speed of the conveyance motor 42 is the same as the rotation speed of the conveyance roller 41.

Furthermore, the rotator control processor 210 selects a pair of adjacent rotators (i.e., two adjacent rollers) from the rotators defining the conveyance path, and controls the rotation speed of one rotator while detecting the torque of the other rotator, in this pair. The rotator control processor 210 selects a pair of rotators while sequentially shifting the pairs of the rotators upstream or downstream in the conveyance direction, and performs similar control for each pair.

Note that, alternatively, selection of a pair of adjacent rotators can be made by the main controller 310. In this case, the rotator control processor 210 desirably acquires information for identifying the selected rotators from the main controller 310.

The driver 221 and the FET 231 have a function for supplying a constant drive current to the intermediate transfer motor 21. The driver 222 and the FET 232 have a function for supplying a constant drive current to the secondary transfer motor 32. The driver 223 and the FET 233 have a function for supplying a constant drive current to the conveyance motor 42.

The rotator control processor 210 acquires the rotation speed of the intermediate transfer belt 10 and the rotation speed of the intermediate transfer motor 21 from the roller encoder 22 of the intermediate transfer roller 11 or the scale sensor 16. Furthermore, the rotator control processor 210 acquires the rotation speeds of the secondary transfer motor 32 and the secondary transfer roller 31, from the motor encoder 34 and the roller encoder 33. In addition, the rotator control processor 210 acquires the rotation speeds of the conveyance motor 42 and the conveyance roller 41 from the motor encoder 45 and the roller encoder 44.

The rotator control processor 210 acquires drive currents of the intermediate transfer motor 21, the secondary transfer motor 32, and the conveyance motor 42, calculates control output for each motor, and outputs to each driver a PWM command value corresponding to the control output. Furthermore, the rotator control processor 210 according to the present embodiment acquires drive currents of the motors rotating the respective rollers defining the conveyance path, calculates control output for each motor, and outputs, to the driver of each motor, a PWM command value corresponding to the control output.

Specifically, the rotator control processor 210 calculates the drive current of each motor in accordance with a PWM command value. However, an error may be generated, affected by fluctuations or the response of a motor drive circuit including the drivers. Therefore, to accurately detect the drive current of each motor, the rotator control processor 210 can measure the current of the FET to calculate the drive current. Specifically, the rotator control processor 210 can detect the drive current from a resultant current value flowing in a shunt resistance coupled to each FET.

In each of the drivers 221, 222, and 223, when a PWM command value is input, the rotation angle of each motor (21, 32, and 42) is recognized by a Hall element signal. Then, each driver converts a PWM signal generated in accordance with the PWM command value to a motor three-phase output signal, and drives each of the motors via the FETs 231, 232, and 233.

The rotator control processor 210 according to the present embodiment operates as described above to control the rotation speeds of the rotators defining the conveyance path based on the command values to the respective motors.

Furthermore, the rotator control processor 210 calculates driving torque based on an acquired drive current. Specifically, the rotator control processor 210 acquires the rotation speeds and the drive currents of the rotators defining the conveyance path (motors corresponding to the rotators), and uses, for example, a torque conversion table representing a relation between torque multiplier and speed to convert drive current into torque.

Furthermore, the rotator control processor 210 stores data acquired or calculated by the rotator control processor 210 in the memory 330, as needed, and reports information, such as abnormal notice, to the main controller 310. Incidentally, the memory 330 may be included in the rotator control processor 210.

As described above, in the present embodiment, the rotator control processor 210 functions as a part of the rotator control device controlling the drive of the plurality of rotators.

Figure 6:
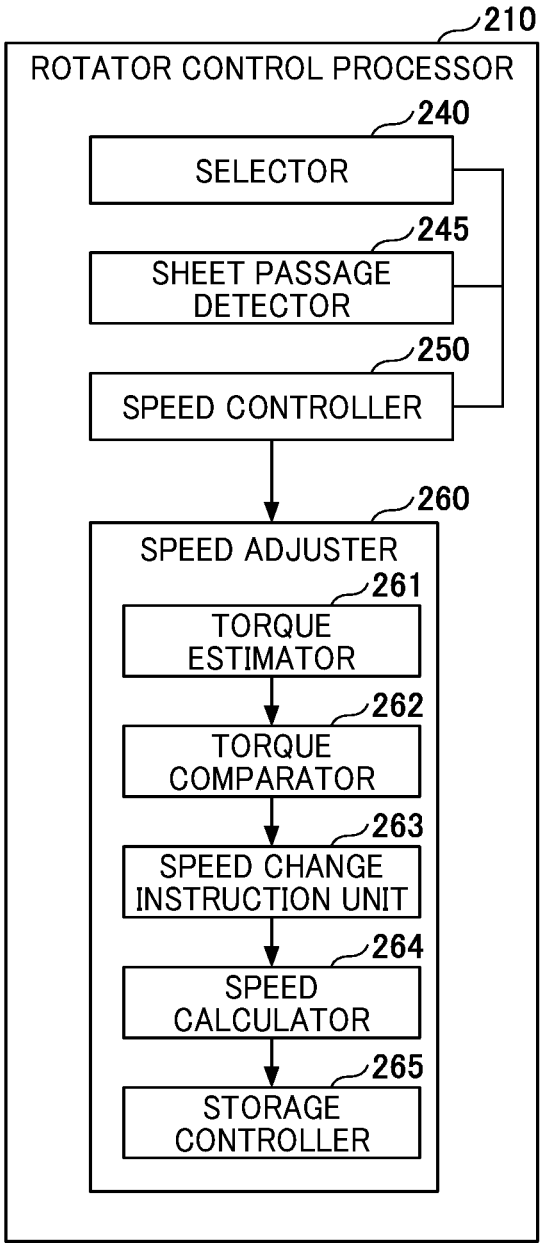
FIG. 6 is a functional block diagram of a rotator control processor according to the first embodiment.

Next, the functions of the rotator control processor 210 according to the present embodiment will be described referring to FIG. 6. FIG. 6 is a diagram illustrating the functions of a rotator control processor according to the first embodiment.

The rotator control processor 210 according to the present embodiment includes a calculation device (the rotator control device) and the like including a memory and the like, and component elements of the rotator control processor 210, which are described later, are implemented by executing a rotator control program stored in the memory by the calculation device.

The rotator control processor 210 according to the present embodiment includes a selector 240, a sheet feeding detector 245, a speed controller 250, and a speed adjuster 260.

The selector 240 selects two adjacent rollers in the conveyance path. Note that the selector 240 according to the present embodiment may also acquire information identifying the rollers selected by the main controller 310 to select two adjacent rollers.

The selector 240 according to the present embodiment firstly selects the intermediate transfer belt 10 in the secondary transfer portion 50, as the reference torque detection rotator (i.e., a reference rotator). Since both of the intermediate transfer belt 10 and the secondary transfer roller 31 are driven in the secondary transfer portion 50, any of the intermediate transfer belt 10 and the secondary transfer roller 31 may be selected as a reference, but, in the present embodiment, for stabilized image formation, the intermediate transfer belt 10 is selected as the reference torque detection rotator (belt).

Next, in the present embodiment, when the rotation speed of a roller upstream from the reference roller is controlled, the conveyance roller 41 adjacent to and upstream from the intermediate transfer belt 10 as the reference is selected as the speed adjustment roller. That is, in this case, the pair of the intermediate transfer belt 10 and the conveyance roller 41 is the first pair of adjacent rollers (i.e., adjacent rotators).

Hereinafter, a description will be made of an example in which first and second conveyance rollers are disposed upstream from the conveyance roller 41 in the conveyance direction and an upstream side of the intermediate transfer belt 10 is to be controlled.

In this configuration, a second pair selected subsequent to the first pair (the intermediate transfer belt 10 and the conveyance roller 41) includes the conveyance roller 41 positioned on the upstream side in the first pair and the first conveyance roller adjacent to and upstream from the conveyance roller 41. In the second pair, the conveyance roller 41 on the downstream side in the conveyance direction is defined as the torque detection roller, and the first conveyance roller on the upstream side in the conveyance direction is defined as the speed adjustment roller.

A third pair subsequent to the second pair (the conveyance roller 41 and the first conveyance roller) includes the first conveyance roller positioned on the upstream in the second pair and the second conveyance roller adjacent to and upstream from the first conveyance roller. In the third pair, the first conveyance roller is defined as the torque detection roller, and the second conveyance roller is defined as the speed adjustment roller. The selector 240 repeats the selection of a pair until a roller at an end on the upstream side in the conveyance direction is selected.

Next, a description will be made of an example in which third and fourth conveyance rollers are disposed downstream from the intermediate transfer belt 10 in the conveyance direction, and the downstream side of the intermediate transfer belt 10 is to be controlled.

In this configuration, the intermediate transfer belt 10 and the third conveyance roller adjacent to and downstream from the intermediate transfer belt 10 are selected as a first pair. In the first pair, the intermediate transfer belt 10 is defined as the torque detection roller, and the third conveyance roller is defined as the speed adjustment roller.

A second pair selected subsequent to the first pair includes the third conveyance roller positioned on the downstream side in the first pair, and the fourth conveyance roller adjacent to and downstream from the third conveyance roller. In the second pair, the third conveyance roller on the upstream side in the conveyance direction is defined as the torque detection roller, and the fourth conveyance roller on the downstream side in the conveyance direction is defined as the speed adjustment roller. The selector 240 continues the selection of a pair until a roller at an end on the downstream side in the conveyance direction is selected.

That is, after adjustment of the rotation speed of the speed adjustment roller, the selector 240 according to the present embodiment selects a first speed adjustment roller as a second torque detection roller, and selects a roller adjacent to the first speed adjustment roller, on a side opposite to the side of a first torque detection roller as a second speed adjustment roller.

In the present embodiment, since a pair of rollers is selected as described above, even when a pair is shifted upstream, or even when a pair is shifted downstream, the speed adjustment roller is not affected by a roller positioned upstream from the speed adjustment roller or by a roller positioned downstream from the speed adjustment roller, and the control can be achieved.

Note that in the selector 240 according to the present embodiment, a direction to be controlled may be set on any of the upstream side and downstream side of the intermediate transfer belt 10 as the reference. The selector 240 may select the speed adjustment roller and the torque detection roller based on this setting.

The sheet feeding detector 245 detects the arrival of the recording medium at each roller and the passage of the recording medium through each roller.

The speed controller 250 controls the rotation speed of each roller. Specifically, the speed controller 250 changes rotation speed or sets a target value of rotation speed for a motor corresponding to each roller. Furthermore, the speed controller 250 performs feedback control so that the rotation speed of each motor has a target value included in the motor information.

The speed adjuster 260 adjusts a target value of the rotation speed of a motor corresponding to two rollers selected by the selector 240 to eliminate torque interference between the two rollers.

The speed adjuster 260 according to the present embodiment includes a torque estimator 261, a torque comparator 262, a speed change instruction unit 263, a speed calculator 264, and a storage controller 265.

The torque estimator 261 according to the present embodiment calculates an estimated driving torque for rotating the torque detection roller in the pair selected by the selector 240. In other words, the torque estimator 261 according to the present embodiment is an acquisition unit to acquire the driving torque of the motor rotating the torque detection roller.

As an example of a method for calculating an estimated driving torque, a method for calculating an estimated value of the driving torque Ta of the intermediate transfer motor 21 will be described below.

The torque estimator 261 defines a load torque value calculated based on a PWM command value output to the driver 221 and the rotation speed of the intermediate transfer motor 21 obtained from the scale sensor 16, as the driving torque Ta. When each motor is accurately controlled to a constant speed or a predetermined speed, the estimated value of the driving torque Ta can be calculated based on a current value, PWM command value, or the like supplied to the motor.

Note that, in the present embodiment, calculation of the estimated value of the driving torque Ta is the same as calculation of the driving torque Ta.

The torque comparator 262 calculates an average value T1 of the driving torque of the torque detection roller in the first conveyance zone, and an average value T2 of the driving torque of the torque detection roller in the second conveyance zone in a pair selected by the selector 240, and compares the average value T1 and the average value T2.

The speed change instruction unit 263 gives an instruction for changing the rotation speed, to a motor rotating the speed adjustment roller, in accordance with a result of the comparison by the torque comparator 262.

In the following description, a motor rotating the torque detection roller is referred to as a torque detection motor, and a motor rotating the speed adjustment roller is referred to as a speed adjustment motor.

The speed calculator 264 calculates a target value of the rotation speed of the torque detection motor, and a target value of the rotation speed of the speed adjustment motor, based on a result of the comparison by the torque comparator 262. In other words, the speed calculator 264 is a setting member setting the rotation speed of the torque detection motor and the rotation speed of the speed adjustment motor.

The storage controller 265 stores the rotation speed calculated by the speed calculator 264 (target value) in the memory 330.

Figure 7:
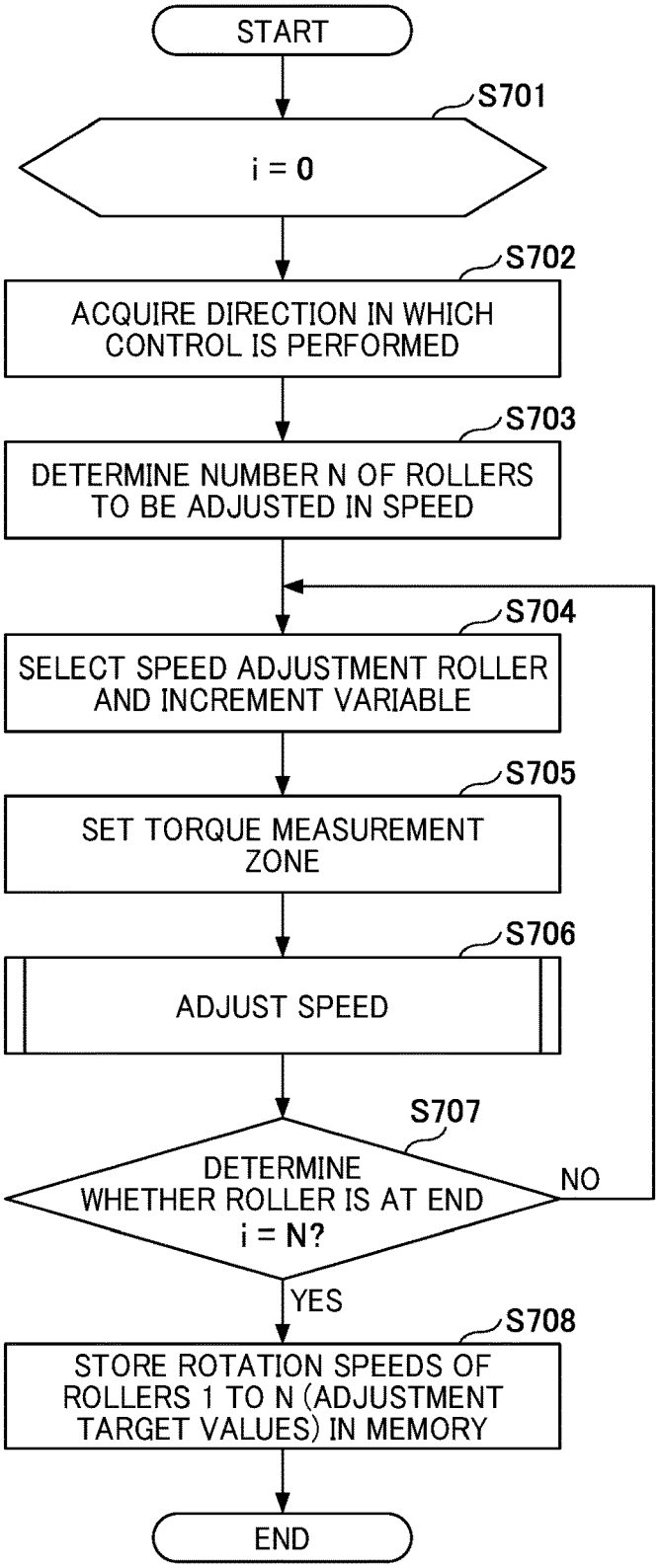
FIG. 7 is a first flowchart illustrating operations of the rotator control processor according to the first embodiment.
Figure 8:
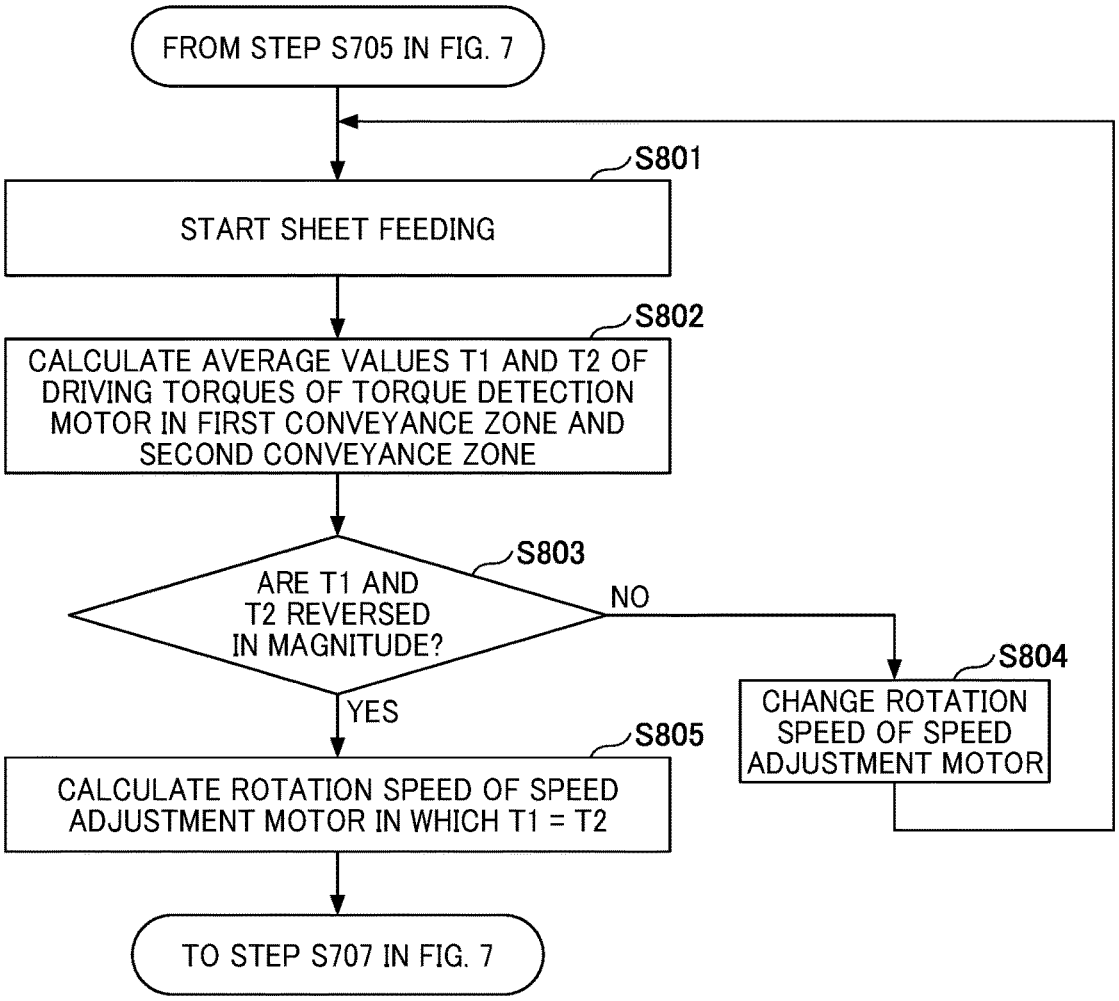
FIG. 8 is a second flowchart illustrating operations of the rotator control processor according to the first embodiment.

Next, the operations of the rotator control processor 210 according to the present embodiment will be described, referring to FIGS. 7 and 8. FIG. 7 is a first flowchart illustrating the operations of the rotator control processor according to the first embodiment.

Note that a process illustrated in FIG. 7 may be performed at predetermined timing, such as shipping of the image forming apparatus 300 or start of use of the image forming apparatus 300 after installation. Furthermore, the process illustrated in FIG. 7 may be performed when the type of recording medium conveyed by the conveyance device 100 is changed. In addition, the process illustrated in FIG. 7 may be performed at given timing in accordance with an instruction from a user of the image forming apparatus 300, or may be performed at predetermined time intervals. That is, the process of FIG. 7 can be performed at given timing.

The rotator control processor 210 according to the present embodiment causes the selector 240 to set a variable i representing a speed adjustment roller to zero (i =0) as initial setting (step S701).

Next, the rotator control processor 210 causes the selector 240 to acquire a direction in which rotation speed is to be controlled (step S702). Note that, in the present embodiment, the direction to be controlled is set to any of the upstream side or the downstream side relative to a reference roller in the selector 240.

Then, the selector 240 determines the number N (the number of pairs to be selected) of speed adjustment rollers in which the rotation speed is controlled by the speed adjuster 260 (step S703). At this time, the reference roller (intermediate transfer belt 10) is assumed to be a zeroth roller.

Then, the selector 240 selects the speed adjustment roller, and increments the variable i (step S704). Here, the selector 240 firstly selects the speed adjustment roller based on the intermediate transfer belt 10 as the reference roller (rotator) and the direction to be controlled.

For example, when the direction to be controlled is on the upstream side, the selector 240 selects the conveyance roller 41 as the speed adjustment roller. Furthermore, when the direction to be controlled is on the downstream side, the selector 240 selects a roller adjacent to and downstream from the intermediate transfer belt 10, as the speed adjustment roller. At this time, the intermediate transfer belt 10 (torque detection rotator) is a torque detection roller (i-1).

Next, the rotator control processor 210 causes the speed adjuster 260 to set the first conveyance zone and the second conveyance zone. In the first conveyance zone and the second conveyance zone, the driving torque of the torque detection roller is measured (step S705).

In the present embodiment, information such as distance between rollers in the conveyance path or basic conveyance speed is set in advance, and the conveyance zone of the recording medium is calculated referring to the information. Furthermore, timing to measure the driving torque of the torque detection roller is determined for each roller, based on a signal from a detection sensor detecting the passage of the recording medium, a print performance signal, or the like.

Furthermore, in the first conveyance zone, the torque detection roller (i-1) and the speed adjustment roller (i) convey the recording medium. In the present embodiment, at this time, the first conveyance zone is assumed to have no roller (or no nip) conveying the recording medium upstream from the speed adjustment roller (i).

Furthermore, in the second conveyance zone according to the present embodiment, only the torque detection roller (i) conveys the recording medium.

Next, the rotator control processor 210 causes the speed adjuster 260 to adjust the rotation speed of the speed adjustment roller (step S706). The process of step S706 will be described in detail later.

Subsequent to step S706, the rotator control processor 210 determines whether the speed adjustment roller selected by the selector 240 is a roller at an end in the conveyance path (step S707). That is, the rotator control processor 210 determines whether the speed adjustment roller (i) is i=N.

In step S707, when the speed adjustment roller is not the roller at an end, the rotator control processor 210 returns to step S704.

In step S707, when the speed adjustment roller is the roller at an end, the speed adjuster 260 stores the rotation speeds of a speed adjustment roller (1) to a speed adjustment roller (N), as the target values, in the memory 330 (step S708), and finishes the process.

Next, adjustment of the rotation speed of the speed adjustment roller by the speed adjuster 260 according to the present embodiment will be described referring to FIG. 8. FIG. 8 is a second flowchart illustrating the operations of the rotator control processor according to the first embodiment. FIG. 8 illustrates the process of step S706 of FIG. 7 in detail.

The rotator control processor 210 according to the present embodiment starts sheet feeding (step S801). The sheet feeding started here is continued till the end of the process of FIG. 7. In other words, the rotator control processor 210 continues sheet feeding till the end of the process of FIG. 7.

Next, the rotator control processor 210 causes the torque comparator 262 of the speed adjuster 260 to calculate an average value T1 of the driving torque of the torque detection motor in the first conveyance zone, and an average value T2 of the driving torque of the torque detection motor in the second conveyance zone (step S802).

Calculation of the average value T1 and the average value T2 will be described below. When the conveyance of the recording medium is started and arrival of a recording medium at the torque detection roller (second rotator) subsequent to the speed adjustment roller (first rotator) is detected by the sheet feeding detector 245, the rotator control processor 210 causes the torque estimator 261 to calculate the driving torque of the torque detection motor.

The torque estimator 261 determines a variation in driving torque at predetermined intervals and holds the variation. The variation in driving torque may be determined by calculating the driving torque, for example, at predetermined intervals.

Then, when the passage of the recording medium through the speed adjustment roller is detected by the sheet feeding detector 245, the rotator control processor 210 causes the torque comparator 262 to calculate an average value T1 of the driving torque in the first conveyance zone in accordance with the held variation in driving torque.

Next, the rotator control processor 210 causes the sheet feeding detector 245 to detect the passage of the recording medium (e.g., paper sheet K) through the torque detection roller. Then, the torque comparator 262 calculates an average value T2 of the driving torque in the second conveyance zone, in accordance with the variation in driving torque held in a period from the passage of the recording medium through the speed adjustment roller to the passage of the recording medium through the torque detection roller.

Here, detection of the passage of the recording medium performed by the sheet feeding detector 245 will be described. For detection by the sheet feeding detector 245 according to the present embodiment, there are three methods available: (1) monitoring torques detected by encoders disposed at the speed adjustment motor and the torque detection motor; (2) detecting the start of conveyance of the recording medium by the speed adjustment roller; and (3) monitoring drive current flowing in an FET corresponding to the torque detection motor.

The method of (1) will be described specifically. Torque acting on the torque detection roller is larger during the conveyance of the recording medium, compared with a period in which no recording medium is conveyed. The sheet feeding detector 245 receiving a drive instruction from the main controller 310 monitors torque, after a period in which the rotation speed of the torque detection roller is stabilized. Then, for example, when a variation rate (gradient) of the torque is not smaller than a threshold value, the sheet feeding detector 245 determines that the recording medium is fed to the torque detection roller.

The method of (2) will be described specifically. The speed adjustment roller has a function of adjusting timing so that a toner image on the intermediate transfer belt 10 is printed on the recording medium, and restarting the conveyance. The restart of the conveyance by the speed adjustment roller is reported by the main controller 310, and the main controller 310 reports the restart of the conveyance by the speed adjustment roller to the sheet feeding detector 245.

Since the distance from the speed adjustment roller to the torque detection roller and the conveyance speed are already given, the sheet feeding detector 245 can determine that the recording medium is fed to the torque detection roller, after a predetermined period from the reception of the report. Note that, detection of the passage of the recording medium by a sensor provided near the torque detection roller may be used, in addition to the above description.

The method of (3) will be described. A drive current flowing in an FET increases with increasing load of the torque detection motor. Accordingly, when the recording medium is fed to the torque detection roller, the drive current flowing in an FET increases. Therefore, for example, when a variation rate of (gradient) of the drive current of the torque detection motor is not smaller than a predetermined value, the sheet feeding detector 245 determines that the recording medium is fed to the torque detection roller.

Subsequent to step S802, the rotator control processor 210 causes the torque comparator 262 to compare the average value T1 and the average value T2 to determine whether the average value T1 and the average value T2 are reversed in magnitude (step S803).

When the comparison result indicates that the average value T1 and the average value T2 are not reversed in magnitude (No at S804), the speed adjuster 260 causes the speed change instruction unit 263 to give an instruction for changing the rotation speed of the speed adjustment motor to the speed controller 250 to change the rotation speed in response to the comparison result (step S804), and returns to step S801. Note that a value of the rotation speed before changing is held by the speed change instruction unit 263.

Control of the rotation speed of the speed adjustment motor in step S804 will be described below. As a result of the instruction for changing the speed, the speed controller 250 according to the present embodiment changes the rotation speed of the speed adjustment motor.

When average value T2 is greater than average value T1 (T2>T1), the speed controller 250 reduces the rotation speed of the speed adjustment motor, and when average value T2<average value T1, the speed controller 250 increases the rotation speed of the speed adjustment motor.

When average value T2 is greater than average value T1 (T2>T1), a force pressing against the recording medium is applied to the torque detection roller from the speed adjustment roller. Accordingly, the speed change instruction unit 263 gives an instruction, to the speed controller 250, for reducing the rotation speed of the speed control motor.

When average value T2 is smaller than average value T1 (T2<T1), a force pulling the recording medium is applied to the torque detection roller from the speed adjustment roller. Accordingly, the speed change instruction unit 263 gives an instruction, to the speed controller 250, for increasing the rotation speed of the speed adjustment motor.

When the comparison result indicates that the average value T1 and the average value T2 are reversed in magnitude (Yes at S803), the speed adjuster 260 causes the speed calculator 264 to calculate the rotation speed of the speed adjustment motor satisfying average value T1 being equal to average value T2 (T1=T2), based on a rotation speed of the speed adjustment motor immediately before the reversal in magnitude between the average value T1 and the average value T2, and a rotation speed of the speed adjustment motor after the reversal in magnitude between the average value T1 and the average value (step S805). Then, the process proceeds to step S707 of FIG. 7. Note that the rotation speed calculated here may be held in the speed adjuster 260.

Calculation of the speed by the speed calculator 264 will be described below.

The speed calculator 264 according to the present embodiment defines a value interpolated by linear interpolation according to the primary expression expressed as Formula 1 as the rotation speed of the speed adjustment motor when average value T1 is equal to average value T2 (T1=T2). Note that Formula 1 represents a relation between the rotation speed of the speed adjustment motor and a difference between the average value T1 and the average value T2, where x is the rotation speed of the speed adjustment motor, and y is a difference between the average value T1 and the average value T2.

$$y=a\times x+b \qquad \text{Formula 1}$$

In step S803, the speed calculator 264 according to the present embodiment substitutes x1 and y1 in Formula 1, where x1 is a rotation speed of the speed adjustment motor immediately before the reversal in magnitude between the average value T1 and the average value T2, and y1 is a difference between the average value T1 and the average value T2. Furthermore, in step S803, the speed calculator 264 substitutes x2 and y2 in Formula 1, where x2 is a rotation speed of the speed adjustment motor when the average value T1 and the average value T2 are reversed in magnitude, and y2 is a difference between the average value T1 and the average value T2. Thus, the following Formulas 2 and 3 are determined.

$$y1=a\times x1+b \qquad \text{Formula 2}$$

$$y2=a\times x2+b \qquad \text{Formula 3}$$

The following Formulas 4 and 5 are determined by Formulas 2 and 3, respectively.

$$a=(y1-y2)/(x1-x2) \qquad \text{Formula 4}$$

$$b=(y2\times x2-y1\times x1)/(x1-x2) \qquad \text{Formula 5}$$

The primary expression of Formula 1 is determined by Formulas 4 and 5. In the present embodiment, the rotation speed of the speed adjustment motor when a difference between the average value T1 and the average value T2 is zero is required. Accordingly, the speed calculator 264 defines the rotation speed x when the difference y is zero (y=0) as the rotation speed of the speed adjustment motor when average value T1 equals average value T2, in Formula 1.

In the present embodiment, the rotator control processor 210 processes as described above to adjust the rotation speeds of the speed adjustment motors, ranging from a speed adjustment motor included in a reference pair to a speed adjustment motor of a roller at an end on the upstream side or downstream side in the conveyance path.

Note that, in the present embodiment, the rotator control processor 210 can determine the interference torque of the intermediate transfer motor 21, for example, after completion of the process illustrated in FIG. 7, to determine whether the interference torque is made close to zero. At this time, for example, the rotator control processor 210 can determine whether the interference torque is not greater than a target torque that does not affect an image output unit.

As described above, the present embodiment attains an effect that torque interference is reduced in a conveyance path defined by three or more rollers.

Note that, in the present embodiment, a description has been made of the example of controlling the rotation speeds of the rotators defining the conveyance path to eliminate the interference torque applied to the intermediate transfer belt, but the configuration to which the present embodiment is applied is not limited to this description.

The control method according to the present embodiment can be applied to, for example, an image forming apparatus including a photoconductor belt. The configuration for such a case is configured to eliminate or minimize interference torque applied to the photoconductor belt. The present embodiment may be applied to any device, as long as the device includes a plurality of pairs of rotators to convey a medium.

Second Embodiment

Hereinafter, a second embodiment will be described referring to the drawings. The second embodiment is different from the first embodiment in that another value is substituted for the estimated value of the driving torque Ta. Therefore, in the following description of the second embodiment, only differences from the first embodiment will be described. Components having functional configurations similar to functional configurations of the first embodiment are denoted by reference signs similar to the reference signs used in the description of the first embodiment, and the description of the similar functional configurations will be omitted.

In the image forming apparatus, in a state where the rotators defining the conveyance path, such as the intermediate transfer motor 21, the secondary transfer motor 32, and the conveyance motor 42, are controlled to rotate at a constant rotation speed, a value other than the estimated value of the driving torque can be substituted for the driving torque Ta of the intermediate transfer motor 21.

That is because a variation in interference torque due to a difference between the rotation speeds of the intermediate transfer belt 10, the secondary transfer roller 31, and the conveyance roller 41 is a variation in frequency band of a control band used for feedback control.

As each motor is controlled in feedback control, the rotation speed of each motor is reflected in the rotator control processor. That is, the variation in driving torque of each motor is also reflected in signals upstream from that motor.

Therefore, in the present embodiment, instead of the driving torque Ta of the intermediate transfer motor 21, a current command value, drive current, an actual PWM measurement value, an actual torque measurement value, or the like supplied to the intermediate transfer motor 21 is used (i.e., torque-related value). In other words, the current command value, the drive current, the actual PWM measurement value, the actual torque measurement value, or the like supplied to the intermediate transfer motor 21 is used as a value representing the conveyance force of the intermediate transfer motor 21.

Note that, in the present embodiment, each value representing the conveyance force of the intermediate transfer motor 21 is proportional to the driving torque Ta.

Since the above-mentioned values are usable as the conveyance force of the intermediate transfer motor 21, the control of the rotation speeds of the rotators defining the conveyance path is performed by the rotator control processor, in a similar manner to that in the first embodiment.

Figure 9:
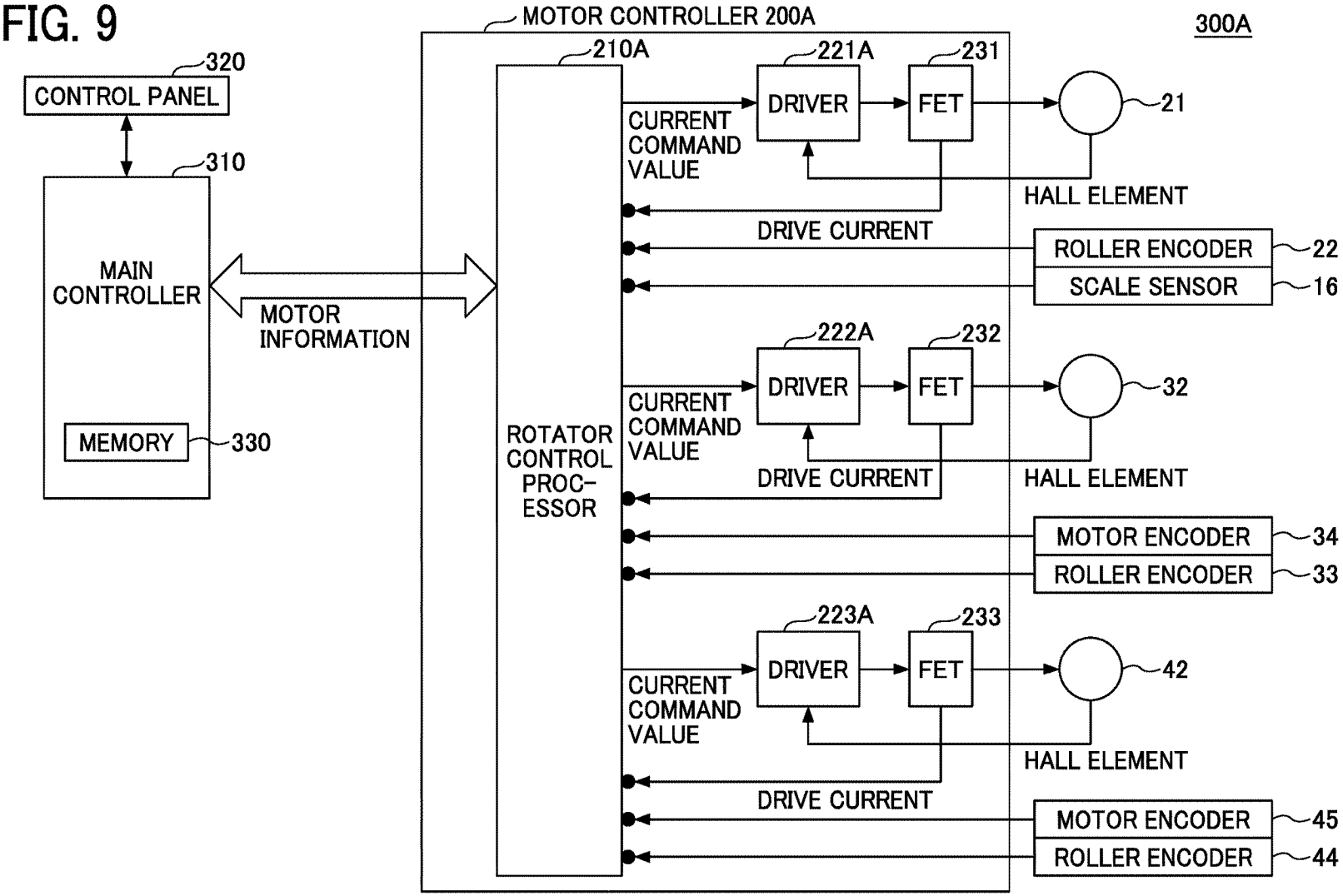
FIG. 9 is a diagram illustrating a motor controller using a current command value.

FIG. 9 is a diagram illustrating a motor controller using the current command value. A motor controller 200A of an image forming apparatus 300A of FIG. 9 includes a rotator control processor 210A, drivers 221A, 222A, and 223A, and FETs 231, 232, and 233.

The rotator control processor 210A outputs, to each driver, the current command value indicating current to be supplied to the corresponding motor.

The rotator control processor 210A according to the present embodiment includes an acquisition unit to acquire the current command value, and the current command value acquired by the acquisition unit is substituted for the driving torque Ta of the intermediate transfer motor 21.

Figure 10:
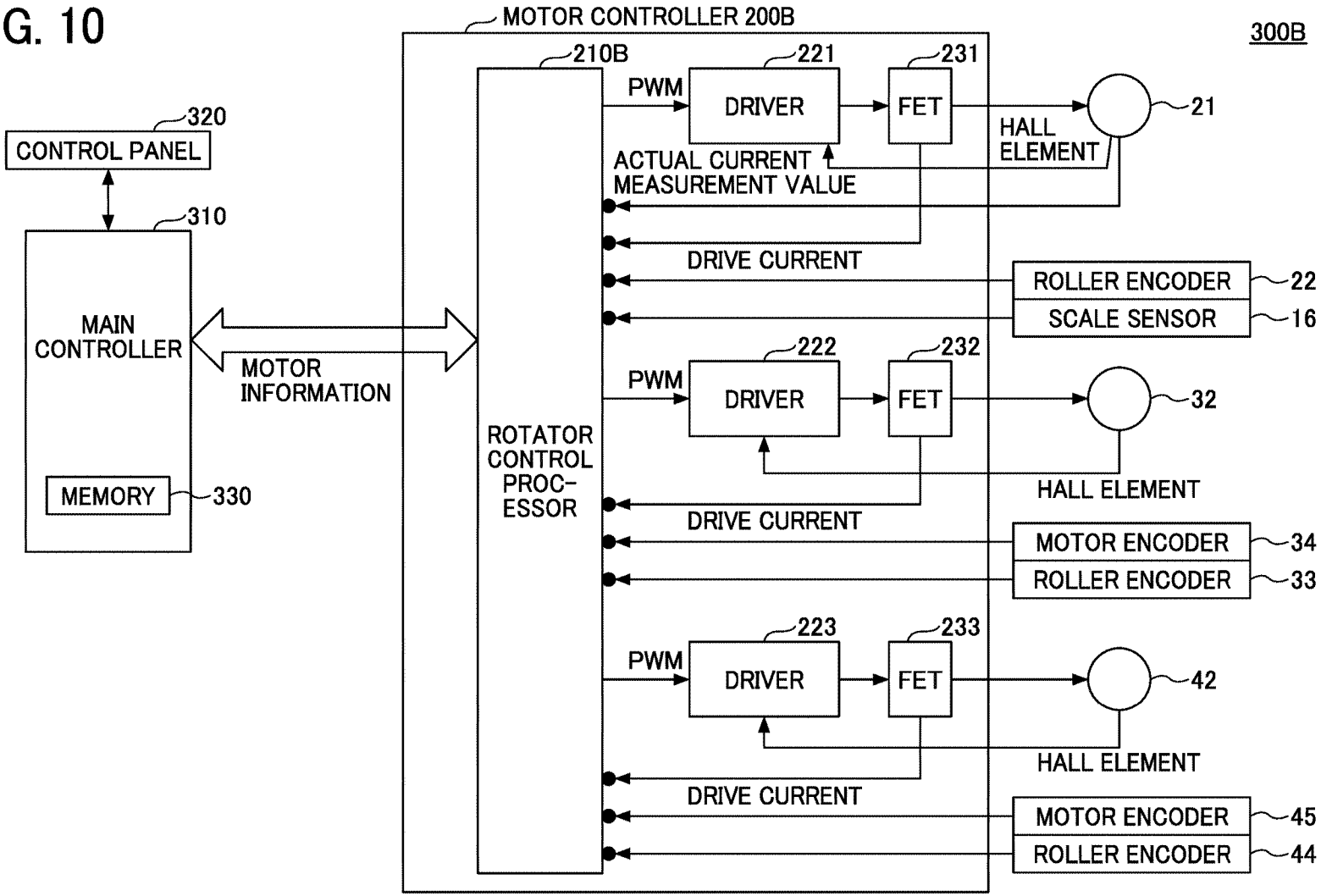
FIG. 10 is a diagram illustrating a motor controller using an actual current measurement value.

FIG. 10 is a diagram illustrating a motor controller using an actual current measurement value.

A motor controller 200B of an image forming apparatus 300B of FIG. 10 includes a rotator control processor 210B, drivers 221, 222, and 223, and FETs 231, 232, and 233.

The rotator control processor 210B includes an acquisition unit to acquire an actual measurement value of current flowing in the intermediate transfer motor 21 from a current detection sensor detecting current flowing in the intermediate transfer motor 21, and the actual measurement value of current acquired by the acquisition unit is substituted for the driving torque Ta of the intermediate transfer motor 21.

Figure 11:
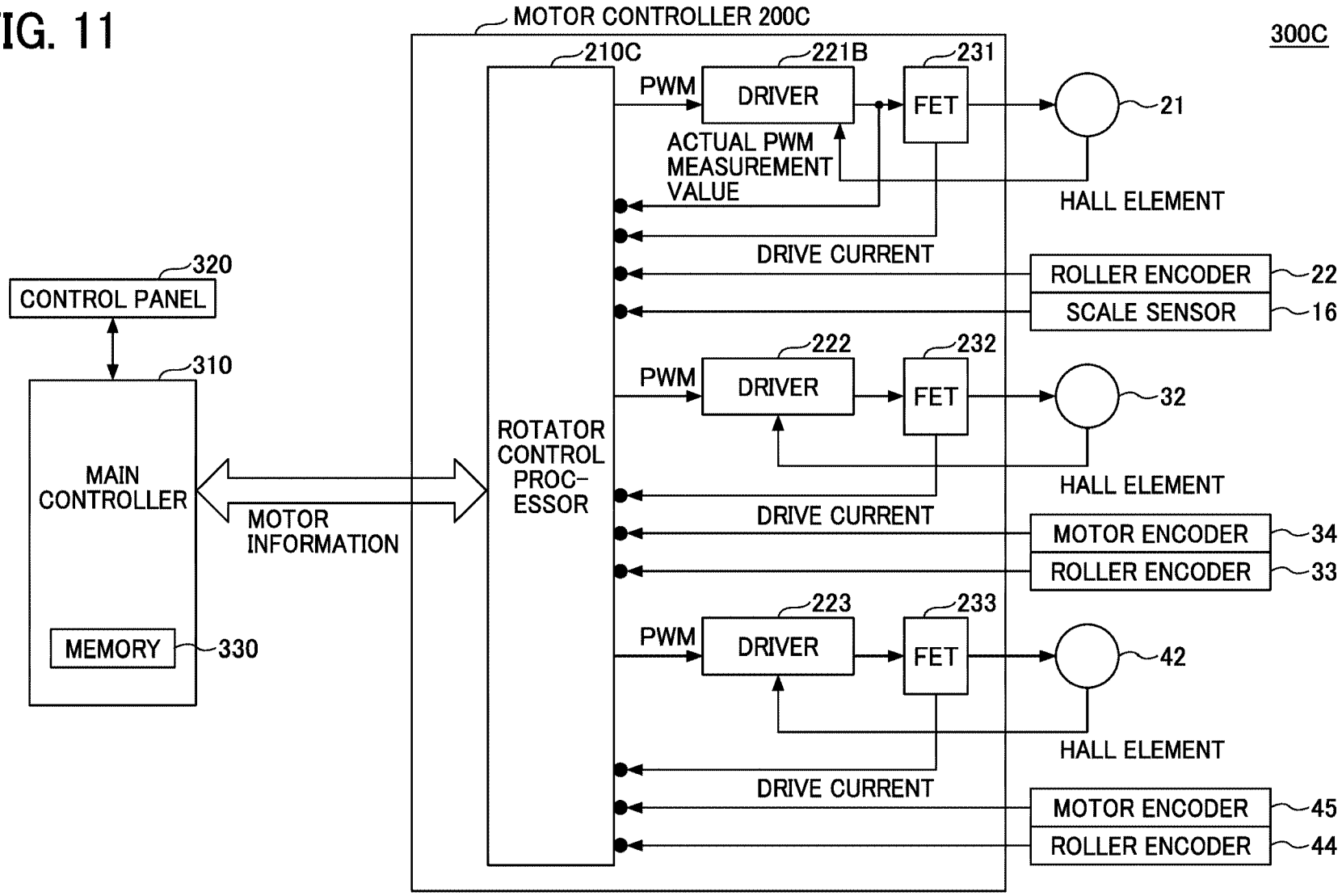
FIG. 11 is a diagram illustrating a motor controller estimating driving torque from an actual pulse width modulation (PWM) measurement value.

FIG. 11 is a diagram illustrating a motor controller estimating driving torque from an actual PWM measurement value.

A motor controller 200C of an image forming apparatus 300C of FIG. 11 includes a rotator control processor 210C, drivers 221B, 222, and 223, and FETs 231, 232, and 233.

The driver 221B according to the present embodiment outputs a duty cycle of a PWM signal as an actual PWM measurement value to the rotator control processor 210C. The duty cycle of a PWM signal is generated in accordance with a PWM command value supplied from the rotator control processor 210C. More specifically, the driver 221B includes, for example, a clock counter to output the duty cycle of a PWM signal generated by the driver 221B in accordance with the number of clocks counted to the rotator control processor 210C.

The rotator control processor 210C includes an acquisition unit to acquire the actual PWM measurement value, and the actual PWM measurement value acquired by the acquisition unit is substituted for the driving torque Ta of the intermediate transfer motor 21.

Figure 12:
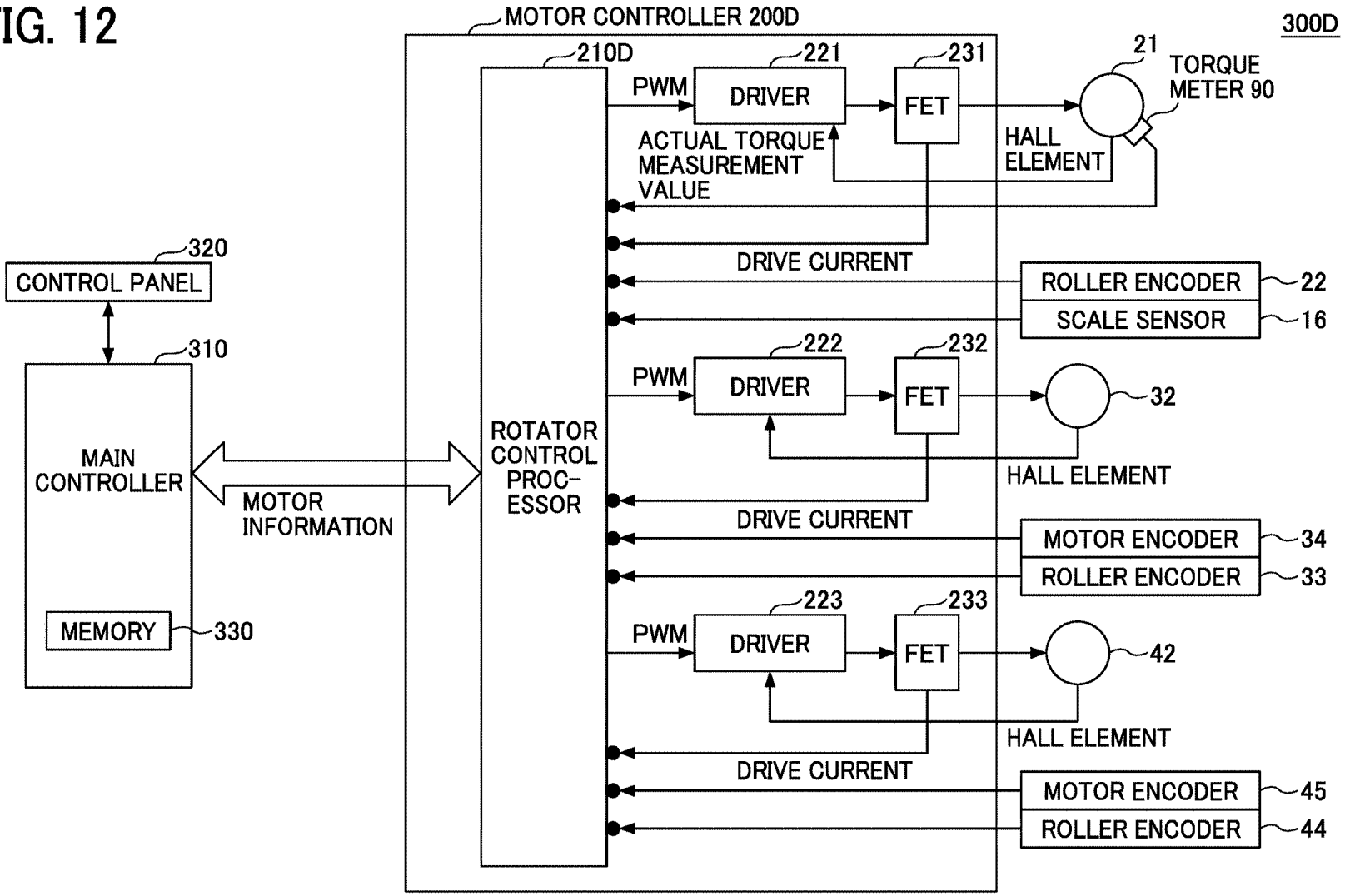
FIG. 12 is a diagram illustrating a motor controller using an actual torque measurement value.

FIG. 12 is a diagram illustrating a motor controller using an actual torque measurement value.

A motor controller 200D of an image forming apparatus 300D of FIG. 12 includes a rotator control processor 210D, drivers 221, 222, and 223, and FETs 231, 232, and 233.

In the image forming apparatus 300D, a torque meter 90 is disposed on the intermediate transfer motor 21, and the torque meter 90 measures the driving torque Ta of the intermediate transfer motor 21. The torque meter 90 outputs a measured driving torque Ta to the rotator control processor 210D.

The rotator control processor 210D includes an acquisition unit to acquire the driving torque Ta measured by the torque meter 90, and the driving torque Ta acquired by the acquisition unit is substituted for the estimated value of the driving torque Ta of the intermediate transfer motor 21.

As described above, according to the present embodiment, another value is substituted for the driving torque Ta of the intermediate transfer motor 21, thereby obviating calculation of the estimated value of the driving torque Ta.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions. Any one of the above-described operations may be performed in various other ways, for example, in an order different from the one described above.

What is claimed is:

1. A rotator control device comprising:

a plurality of drivers to drive a plurality of rotators to convey a sheet, respectively; and a processor including:

a selector configured to select, from the plurality of rotators, a pair of a first rotator subjected to rotation speed adjustment and a second rotator adjacent to the first rotator;

an acquisition unit configured to acquire a torque-related value representing one of a driving torque value of a corresponding driver of the plurality of drivers to drive the second rotator and a value proportional to the driving torque value of the corresponding driver to drive the second rotator; and a speed adjuster configured to adjust a rotation speed of the first rotator to approximate a variation in the torque-related value acquired by the acquisition unit to zero, wherein the selector is configured to:

select a subsequent pair from the plurality of rotators after adjustment of the rotation speed of the first rotator of a preceding pair;

designate the first rotator of the preceding pair as the second rotator of the subsequent pair; and select, as the first rotator of the subsequent pair, one of the plurality of rotators adjacent to the first rotator of the preceding pair, on a side opposite the second rotator of the preceding pair.

2. The rotator control device according to claim 1, wherein the selector is configured to:

select the second rotator of an initial pair as a reference rotator; and select the first rotator based on the reference rotator and one of the plurality of rotators that is an object to be controlled by the speed adjuster.

3. The rotator control device according to claim 1, wherein the acquisition unit is configured to acquire, as the torque-related value, a first torque-related value and a second torque-related value, the first torque-related value representing the torque-related value in a first conveyance zone in which the first rotator and the second rotator hold the sheet, the second torque-related value representing the torque-related value in a second conveyance zone in which one of the first rotator and the second rotator holds the sheet, and wherein the speed adjuster is configured to adjust the rotation speed of the first rotator to make the first torque-related value to coincide with the second torque-related value.

4. The rotator control device according to claim 3, wherein the speed adjuster is configured to:

compare the first torque-related value with the second torque-related value;

increase the rotation speed of the first rotator in response to a comparison result indicating the first torque-related value being greater than the second torque-related value;

reduce the rotation speed of the first rotator in response to a comparison result indicating the first torque-related value being smaller than the second torque-related value; and adjust the rotation speed of the first rotator until the first torque-related value and the second torque-related value are reversed in magnitude.

5. The rotator control device according to claim 4, wherein, based on a rotation speed of the first rotator before reversal in magnitude between the first torque-related value and the second torque-related value, a rotation speed of the first rotator after the reversal, a difference between the first torque-related value and the second torque-related value before the reversal, and a difference after the reversal, the speed adjuster derives a primary expression representing a relation between the rotation speed of the first rotator and the difference, and wherein the speed adjuster is configured to calculate a rotation speed of the first rotator when the difference is zero based on the primary expression.

6. The rotator control device according to claim 1, wherein the selector is configured to select, from the plurality of rotators, one of an extreme upstream rotator and an extreme downstream rotator in a direction of conveyance of the sheet, as the first rotator of an initial pair.

7. The rotator control device according to claim 1, wherein the torque-related value includes at least one of a drive current of the corresponding driver to drive the second rotator, a current command value supplied to the corresponding driver to drive the second rotator, and a PWM command value supplied to the corresponding driver to drive the second rotator.

8. The rotator control device according to claim 1, wherein the acquisition unit is configured to calculate the driving torque value, using a PWM command value output to the corresponding driver to drive the second rotator and a detected rotation speed of the second rotator.

9. The rotator control device according to claim 1, wherein the acquisition unit is configured to calculate the driving torque value, using a drive current supplied to the corresponding driver to drive the second rotator and a detected rotation speed of the second rotator.

10. A conveyance device comprising:

a plurality of rotators to convey a sheet; and a rotator control device including:

a plurality of drivers to drive the plurality of rotators, respectively; and a processor including:

a selector configured to select, from the plurality of rotators, a pair of a first rotator subjected to rotation speed adjustment and a second rotator adjacent to the first rotator;

an acquisition unit configured to acquire a torque-related value representing one of a driving torque value of a corresponding driver of the plurality of drivers to drive the second rotator and a value proportional to the driving torque value of the corresponding driver to drive the second rotator; and a speed adjuster configured to adjust a rotation speed of the first rotator to approximate a variation in the torque-related value acquired by the acquisition unit to zero, wherein the selector is configured to:

select a subsequent pair from the plurality of rotators after adjustment of the rotation speed of the first rotator of a preceding pair;

designate the first rotator of the preceding pair as the second rotator of the subsequent pair; and select, as the first rotator of the subsequent pair, one of the plurality of rotators adjacent to the first rotator of the preceding pair, on a side opposite the second rotator of the preceding pair.

11. An image forming apparatus comprising the conveyance device according to claim 10.

12. A rotator control method to control a plurality of rotators respectively driven by a plurality of drivers to convey a sheet, the method comprising:

selecting, from the plurality of rotators, a pair of a first rotator subjected to rotation speed adjustment and a second rotator adjacent to the first rotator;

acquiring a torque-related value representing one of a driving torque value of a corresponding driver of the plurality of drivers to drive the second rotator and a value proportional to the driving torque value of the corresponding driver to drive the second rotator; and adjusting a rotation speed of the first rotator to approximate a variation in the torque-related value acquired to zero, selecting a subsequent pair from the plurality of rotators after adjustment of the rotation speed of the first rotator of a preceding pair;

designating the first rotator of the preceding pair as the second rotator of the subsequent pair; and selecting, as the first rotator of the subsequent pair, one of the plurality of rotators adjacent to the first rotator of the preceding pair, on a side opposite the second rotator of the preceding pair.

* * * * *